US010655388B2

(12) United States Patent
Smith et al.

(10) Patent No.: US 10,655,388 B2
(45) Date of Patent: May 19, 2020

(54) ADJUSTABLE INTERNAL DOUBLE LIMIT STOP FOR ROLLER SHADES

(71) Applicant: Hunter Douglas, Inc., Pearl River, NY (US)

(72) Inventors: Stephen P. Smith, Denver, CO (US); Kenneth M. Faller, Thornton, CO (US)

(73) Assignee: HUNTER DOUGLAS, INC., Pearl River, NY (US)

( * ) Notice: Subject to any disclaimer, the term of this patent is extended or adjusted under 35 U.S.C. 154(b) by 253 days.

(21) Appl. No.: 15/729,753

(22) Filed: Oct. 11, 2017

(65) Prior Publication Data

US 2018/0106107 A1 Apr. 19, 2018

Related U.S. Application Data

(60) Provisional application No. 62/408,291, filed on Oct. 14, 2016.

(51) Int. Cl.
*E06B 9/88* (2006.01)
*E06B 9/80* (2006.01)
(Continued)

(52) U.S. Cl.
CPC ..... *E06B 9/80* (2013.01); *E06B 9/32* (2013.01); *E06B 9/322* (2013.01); *E06B 9/42* (2013.01); *E06B 9/88* (2013.01)

(58) Field of Classification Search
CPC ..... E06B 9/80; E06B 9/34; E06B 9/40; E06B 2009/402; E06B 9/42; E06B 9/50; E06B 9/88
(Continued)

(56) References Cited

U.S. PATENT DOCUMENTS 5,031,682 A * 7/1991 Tedeschi ..... E06B 9/60 160/315
6,289,964 B1 * 9/2001 Colson ..... E06B 9/32 160/121.1
(Continued)

FOREIGN PATENT DOCUMENTS

CA 2276237 C 12/1999
DE 19928409 A1 12/1999
WO 2014142790 A1 9/2014

OTHER PUBLICATIONS

Extended European Search Report for EP application No. 17196201.2 dated Mar. 12, 2018, 10 pages.

*Primary Examiner* — Daniel P Cahn

(57) ABSTRACT

An architectural covering assembly includes a rotatable roller tube, a covering coupled to the rotatable roller tube, and first and second limit screws each having respective first and second ends. The second end of the first limit screw can engage the first end of the second limit screw. One of the limit screws is rotationally and axially fixed with respect to an end plate. The other of the limit screws is movable between rotationally locked and rotationally unlocked positions with respect to the end plate. Limit nuts are threadably coupled to external threads of the limit screws. In the rotationally locked position the one of the limit screws is axially and rotationally fixed with respect to the end plate, and in the rotationally unlocked position the other of the limit screws is rotationally movable with respect to the end plate to adjust an extension or retraction limit of the covering.

21 Claims, 19 Drawing Sheets

(51) Int. Cl.
*E06B 9/32* (2006.01)
*E06B 9/322* (2006.01)
*E06B 9/42* (2006.01)

(58) Field of Classification Search
USPC ..... 160/293.1
See application file for complete search history.

(56) References Cited

U.S. PATENT DOCUMENTS 6,708,750 B2 3/2004 Collett et al.
6,845,802 B1 1/2005 Anderson et al.
7,857,033 B2 * 12/2010 Malausa ..... E06B 9/88 160/295
8,365,797 B2 2/2013 Drew et al.
8,662,139 B2 3/2014 Anthony et al.
8,752,607 B2 6/2014 Anderson et al.
9,284,774 B2 3/2016 Yu et al.
9,353,570 B2 5/2016 Smith et al.
9,631,425 B2 * 4/2017 Campagna ..... E06B 9/60
9,890,588 B2 * 2/2018 Smith ..... E06B 9/50
9,963,935 B2 * 5/2018 Faller ..... E06B 9/80
2001/0001414 A1 * 5/2001 Colson ..... E06B 9/32 160/178.1 R
2007/0144686 A1 * 6/2007 Drew ..... E06B 9/322 160/170
2008/0190572 A1 * 8/2008 Kwak ..... E06B 9/42 160/313
2008/0202709 A1 * 8/2008 Anderson ..... E06B 9/34 160/321
2008/0223532 A1 * 9/2008 Auger ..... E06B 9/262 160/292
2008/0251624 A1 10/2008 Fraczek et al.
2010/0212843 A1 * 8/2010 Bohlen ..... E06B 9/88 160/168.1 R
2011/0024064 A1 * 2/2011 Ng ..... E06B 9/42 160/317
2011/0139380 A1 * 6/2011 Anthony ..... E06B 9/34 160/293.1
2012/0266413 A1 * 10/2012 Kao ..... E06B 9/42 16/96 D
2013/0153161 A1 * 6/2013 Haarer ..... E06B 9/42 160/293.1
2014/0096920 A1 * 4/2014 MacDonald ..... E06B 9/50 160/291
2014/0216666 A1 * 8/2014 Smith ..... E06B 9/38 160/84.04
2015/0047795 A1 * 2/2015 Bohlen ..... E06B 9/62 160/316
2015/0275575 A1 10/2015 Haarer et al.
2015/0376941 A1 * 12/2015 Fujita ..... E06B 9/26 160/241
2016/0237743 A1 8/2016 Holt et al.
2017/0107760 A1 * 4/2017 Campagna ..... E06B 9/60
2018/0023340 A1 * 1/2018 Goldberg ..... E06B 9/56
2018/0216404 A1 * 8/2018 Fisher ..... E06B 9/50
2019/0153777 A1 * 5/2019 Byun ..... E06B 9/40
2019/0162021 A1 * 5/2019 De Vries ..... E06B 9/42
2019/0376339 A1 * 12/2019 Cheng ..... E06B 9/88
2019/0376340 A1 * 12/2019 Smith ..... E06B 9/88

* cited by examiner

ADJUSTABLE INTERNAL DOUBLE LIMIT STOP FOR ROLLER SHADES

CROSS-REFERENCE TO RELATED APPLICATIONS

This is a non-provisional of pending U.S. provisional patent application Ser. No. 62/408,291, filed Oct. 14, 2016, titled "Adjustable Internal Double Limit Stop for Roller Shades," the entirety of which application is incorporated by reference herein.

FIELD OF THE DISCLOSURE

The present disclosure relates generally to architectural covering assemblies, and more particularly to a system and method for providing multiple travel limits for architectural covering assemblies.

BACKGROUND OF THE DISCLOSURE

Coverings for architectural openings, such as windows, doors, archways, and the like, have taken numerous forms for many years. Some known architectural covering assemblies include a flexible covering such as fabric coupled to a rotatable roller that is movable between an extended position and a retracted position. A drive mechanism enables a user to raise and lower the flexible covering by rolling the covering onto or off of the rotatable roller. To avoid snaring or jamming of the covering and/or the drive mechanism, some known covering assemblies include positive stops located at the lower corners of the flexible covering. These stops engage respective stops on the headrail or end caps in which the rotatable roller is coupled to provide a physical limit to the raised position of the covering and to prevent the covering from being over wound on to the rail. Additionally, some coverings have included a single stop in the headrail and/or within the rotatable rail itself to provide a limit on the lowered position of the covering. The positive stops on the lower corners of the flexible material can be effective, but some consumers do not like their appearance.

SUMMARY

It would be desirable to provide a system having extension and retraction travel limits for a roller shade, where the mechanism for providing such travel limits is disposed entirely inside the roller tube. In some embodiments the first travel limit may be adjustable, either by an installer or consumer, while the second travel limit may be a fixed position that is not adjustable by the installer or user. Allowing an installer or user to adjust the first travel limit may be useful to accommodate fabric settling, or consumer preferences for making fine adjustments to the end position of the shade in their window. The second travel limit may be adjusted and set at the factory prior to final assembly of the system, and would therefore not be adjustable by the installer or consumer. In one embodiment, the adjustable limit may be adjusted by inserting a tool through an opening in the end plate, disengaging a portion of the limit assembly, and then actuating the tool. The actuation may facilitate adjustment of the stop position for the adjustable limit, thus adjusting the total amount of extension the roller shade can undergo. In some embodiments a release tool can be provided to disengage the adjustable limit so that the roller shade can be freely adjustable, which may be desirable during fabrication of the shade.

As mentioned, the entirety of the travel limit mechanism can be disposed internal to the roller tube and end plate, thereby eliminating issues relating to external limit devices (e.g., poor reliability, undesirable cosmetics, mis-adjustment, and space consumption).

BRIEF DESCRIPTION OF THE DRAWINGS

By way of example, embodiments of the disclosed device will now be described, with reference to the accompanying drawings, in which.

DETAILED DESCRIPTION

The following disclosure is intended to provide non-limiting examples embodiments of the disclosed system and method, and these example embodiments should not be interpreted as limiting, or more desirable, than other embodiments which may embody one or more principles disclosed herein. One of ordinary skill in the art will understand that the steps and methods disclosed may easily be reordered and manipulated into many configurations, provided they are not mutually exclusive. As used herein, "a" and "an" may refer to a single or plurality of items and should not be interpreted as exclusively singular unless explicitly stated.

The description will proceed in relation to an architectural structure, which, without limitation, may be an opening such as a window, doorway, archway, or the like. It will be appreciated that references to an architectural opening/structure are made for convenience, and without intent to limit the present disclosure to a particular structure.

Some known architectural covering assemblies can include a flexible covering such as fabric coupled to a rotatable roller tube. The covering can be raised or lowered by rolling the covering onto or off of the rotatable roller via a drive mechanism operatively coupled to the roller tube. Physical limits to the raised and/or lowered positions of the covering can be provided to prevent jamming of the driving mechanism and to prevent snaring or overwinding of the covering.

In the raised/retracted position the covering may be wound on the roller tube, while in the lowered/extended position the covering may be unrolled from the roller tube. A first limit stop may be disposed within the roller tube and may prevent the roller tube from winding the covering onto the tube when the covering has reached a desired raised position. A second limit stop may be also be disposed within the roller tube and may prevent the roller tube from unwinding the covering from the tube once the covering has reached a desired lowered position.

Figure 1:
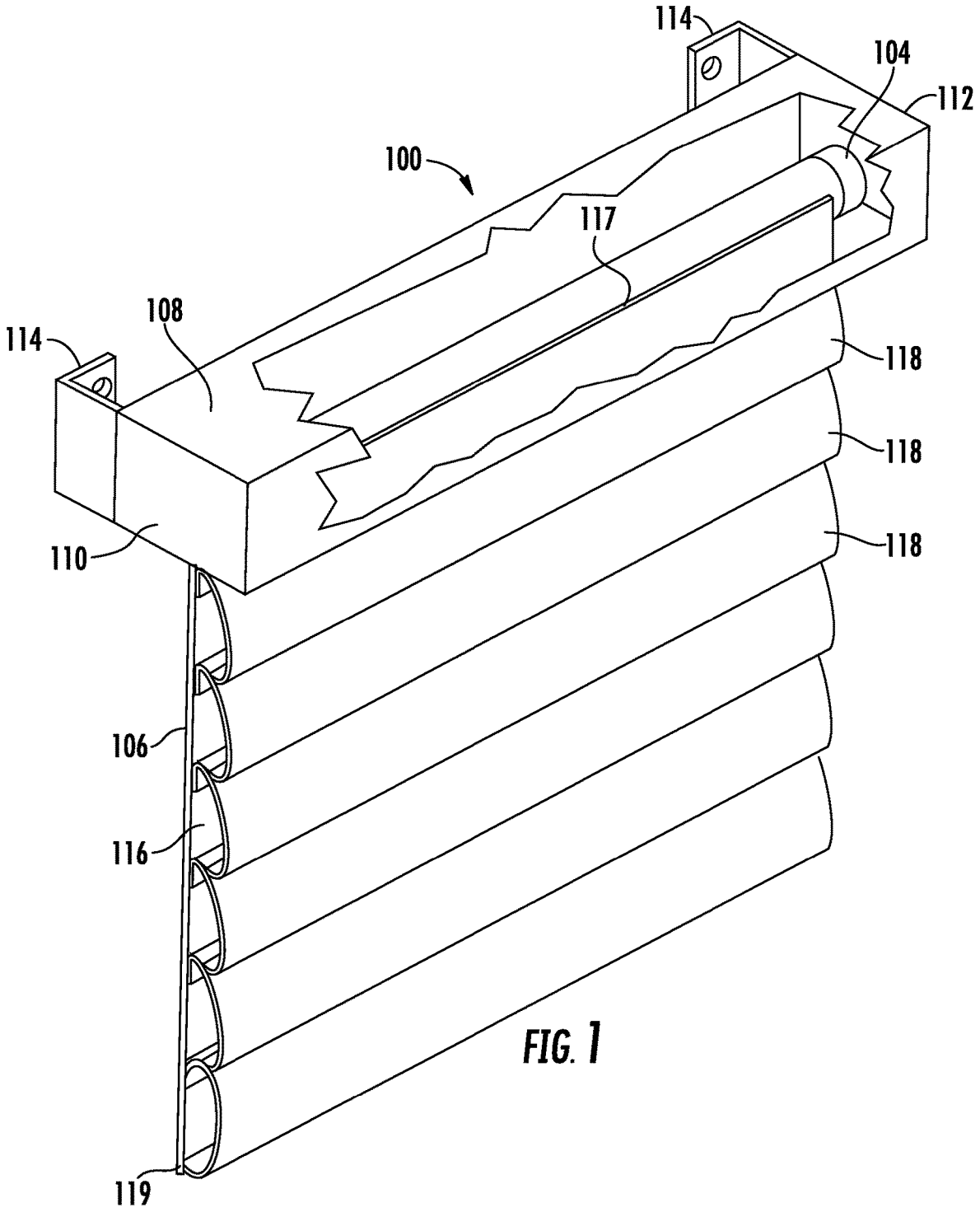
FIG. 1 is an example of an architectural covering assembly.

FIG. 1 shows an example of an embodiment of an architectural covering assembly 100 that includes a non-limiting example travel limit assembly according to the present disclosure. The covering assembly 100 includes a headrail 108, which in the illustrated embodiment is a housing having opposed end caps 110, 112 joined by front, back, and top sides to form an open bottom enclosure. The headrail 108 also has mounts 114 for coupling the headrail 108 to a structure above an architectural opening, such as a wall, via mechanical fasteners such as screws, bolts, or the like. A roller tube 104 is rotatably coupled between the end caps 110, 112. Although a particular example of a headrail 108 is shown in FIG. 1, many different types and styles of headrails exist and could be employed in place of the example headrail of FIG. 1.

In the example illustrated in FIG. 1, the covering 106 is a unitary sheet of flexible material 116 having an upper edge 117 coupled to the roller tube 104 and a lower, free edge 119. However, it will be appreciated that other mounting arrangements are within the scope of the present disclosure. The covering 106 is movable between a retracted position and an extended position (illustratively, the position shown in FIG. 1). When in the retracted position, the covering 106 is wound about the roller tube 104. Although not shown, a drive mechanism can be provided to move the covering between the raised and lowered positions. The drive mechanism can take any appropriate form (e.g., a clutch, a gear, a motor, a drive train, and/or a gear train, etc.) and can include any type of controls (e.g., continuous loop, raise/lower cord(s), chains, ropes, etc).

Figure 2:
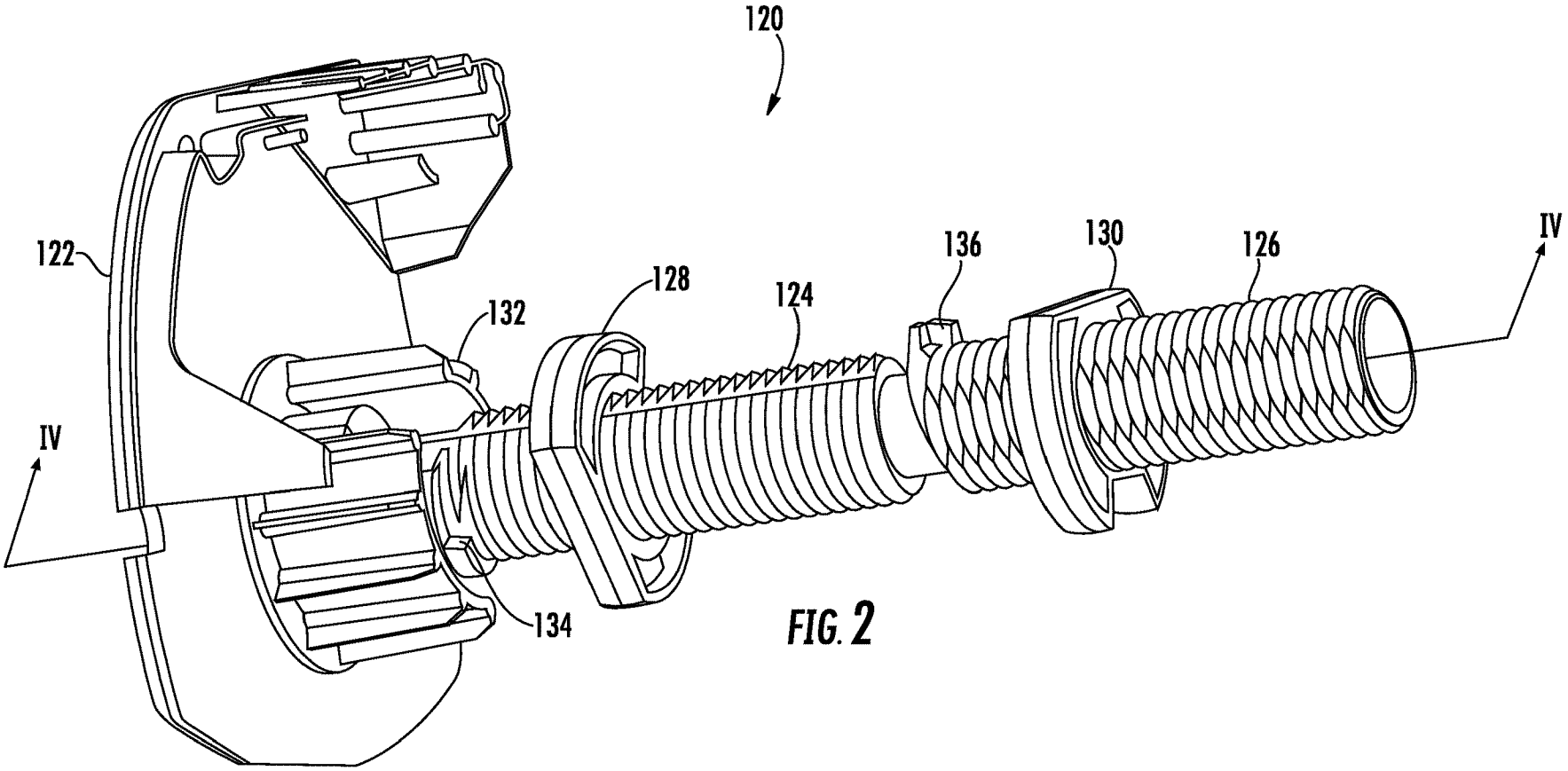
FIG. 2 is a perspective view of an example of an adjustment assembly for use in the architectural covering assembly of FIG. 1.

FIG. 2 shows a non-limiting example travel limit assembly 120 for adjusting and limiting the amount of extension and retraction that the roller tube 104 and covering 106 can undergo in operation. Such limits can provide both aesthetic and operational benefits. As will be appreciated, from an aesthetic standpoint it may be desirable to place a retraction limit on the covering 106 so that, in the fully retracted position, a portion of the covering remains visible near the top of the architectural opening. It may also be desirable to provide an extension limit on the covering 106 so that, in the fully extended position, the bottom end of the covering settles at a desired distance above a structural bottom feature of the architectural opening (e.g., a sill). From an operational standpoint, setting extension and retraction limits can avoid snaring or jamming of the covering and/or the drive mechanism.

The example travel limit assembly 120 includes an end plate 122, first and second limit screws 124, 126, first and second limit nuts 128, 130, and a bushing 132. The first and second limit screws 124, 126 are, during normal operational extension and retraction of the roller tube 104, rotationally fixed with respect to the end plate 122. The first and second limit nuts 128, 130 may be threadably engaged with external threads of the first and second limit screws 124, 126 and may be rotationally fixed with respect to the roller tube 104 (FIG. 1). The bushing 132 may be positioned directly adjacent to the end plate 122, and may also be fixed with respect to the roller tube 104 so that as the roller tube 104 rotates, the bushing 132, as well as the first and second limit nuts 128, 130, may rotate with respect to the end plate 122 and the first and second limit screws 124, 126. It will be appreciated that the end plate 122 is optional, and that the disclosure can encompass other elements with respect to which the first and/or second limit screws 124, 126 can be rotationally fixed or rotatable with respect thereto.

Since the first and second limit nuts 128, 130 are rotationally fixed with respect to the roller tube 104, as the roller tube rotates to extend or retract the covering 106, the first and second limit nuts travel axially along the respective first and second limit screws 124, 126. Rotation of the roller tube 104 will continue unimpeded until one of the first and second limit nuts 128, 103 encounters a stop surface 134, 136, which, in the illustrated embodiment, comprise surfaces disposed at predetermined positions on the first and second limit screws 124, 126. When the first or second limit nut 128, 130 engages a respective first or second stop surface, 134, 136, further rotation of the roller tube 104 is prevented so that the covering 106 cannot extend (or retract) further.

It will be appreciated that in common usage, one of the first and second limit nuts 128, 130 may serve as a retraction limit, while the other of the first and second limit nuts may serve as an extension limit. It will also be appreciated that by adjusting the initial positions of the first and second limit nuts 128, 130 along the lengths of the first and second limit screws 124, 126, the total distance each nut can travel before engaging a stop surface of the associated limit screw can be adjusted. Since the travel distance of each nut along its associated limit screw is proportional to a number of revolutions of the roller tube 104, adjusting the position of the limit nuts on the limit screws proportionally adjusts the total number of revolutions the roller tube 104 and covering 106 are allowed to undergo in the extension and retraction directions. As a result, adjusting the initial positions of the first and second limit nuts 128, 130 on the first and second limit screws 124, 126 enables the extension and retraction limits for the roller tube 104 and covering 106 to be adjusted.

Figure 3:
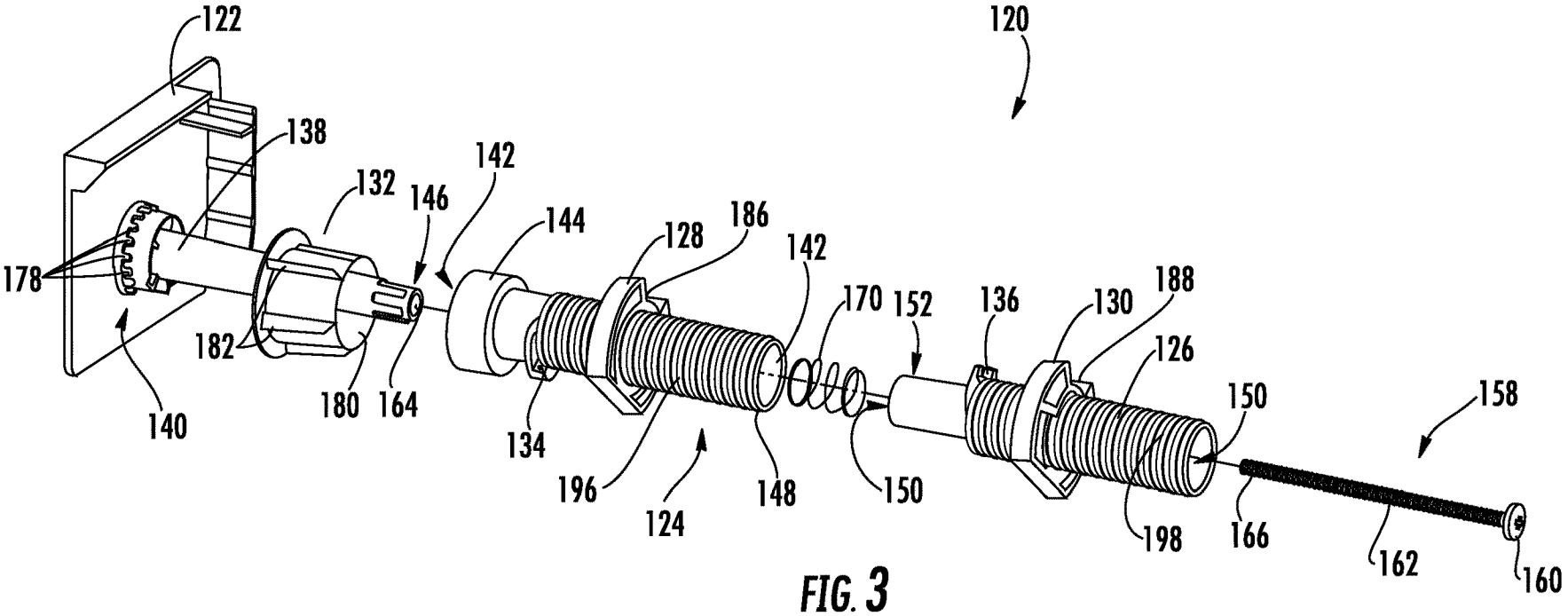
FIG. 3 is an exploded view of the example of an adjustment assembly of FIG. 2.
Figure 4:
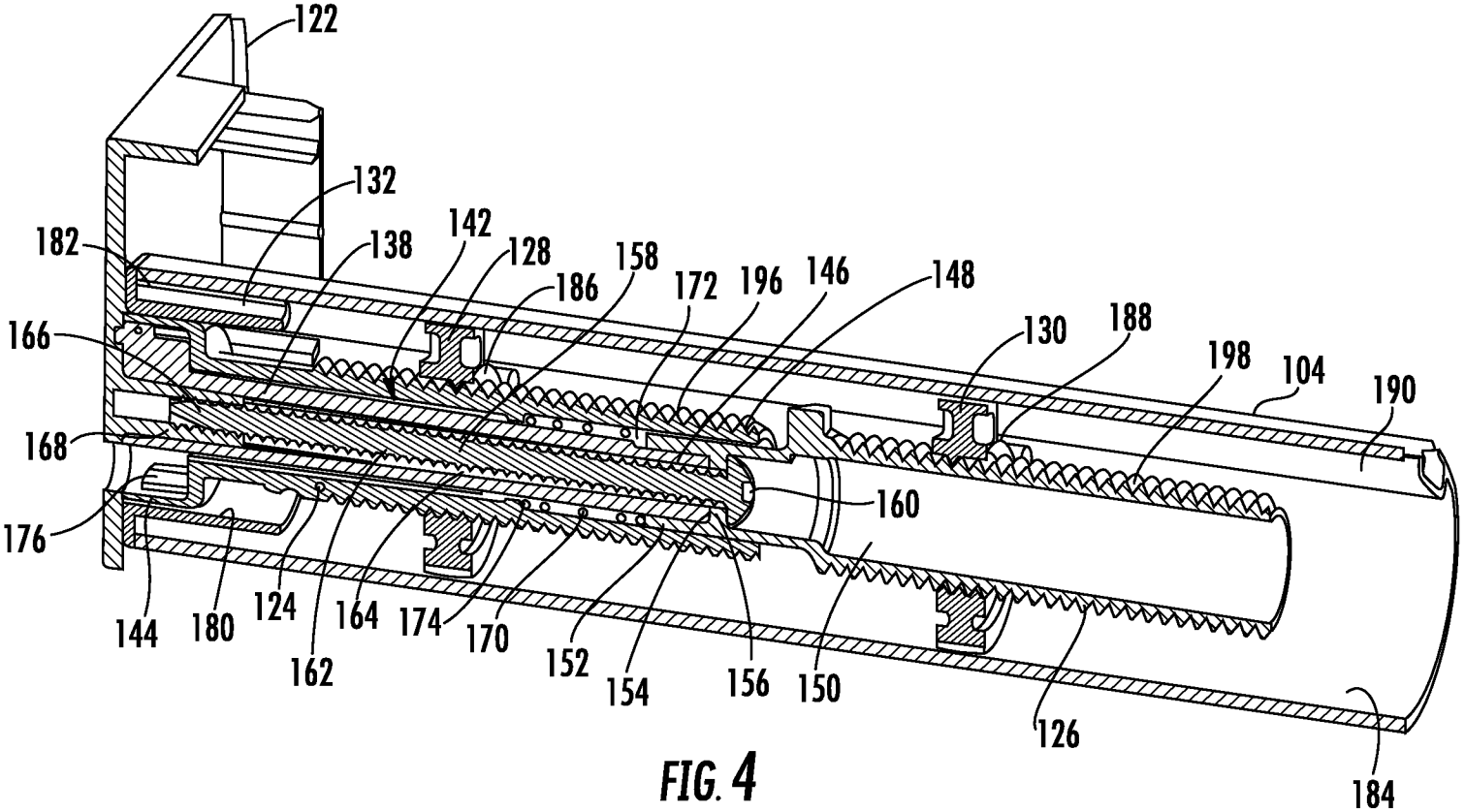
FIG. 4 is a cross-sectional perspective view, taken along line IV-IV of FIG. 2, of the example of an adjustment assembly of FIG. 2.

Referring now to FIGS. 3 and 4, the inter-relationship between elements of the example travel limit assembly 120 will be described in greater detail. In general, the example travel limit assembly 120 includes first limit screw 124 and end plate 122 that are rotationally fixed with respect to each other, but that allow for selective disengagement to thereby allow rotation of first limit screw 124 and thus adjustment of the first limit nut 128 with respect to a stop surface 134 of the first limit screw. As can be seen, FIG. 3 shows the travel limit assembly 120 without the roller tube 104, while FIG. 4 shows the assembly in the context of the roller tube 104. As shown, in addition to the elements described in relation to FIG. 2, the travel limit assembly 120 may include an axle 138 having a first end 140 coupled with (e.g., axially and rotationally fixed) to the end plate 122. The axle 138 may, among other things, serve to support the first and second limit screws 124, 126 and the roller tube 104 on the end plate 122.

As best seen in FIG. 4, the axle 138, and first and second limit screws 124, 126 may have a nested configuration in which the axle 138 is received within the first limit screw 124, and a portion of the second limit screw 126 is received within a portion of the first limit screw 124. Specifically, the axle 138 may be receivable within a bore 142 of the first limit screw 124 so that, when assembled, a first end 144 of the first limit screw 124 is positionable directly adjacent to the end plate 122. As will be discussed in greater detail below, positioning a first end 144 of the first limit screw 124 directly adjacent to the end plate 122 enables radially-inwardly oriented projections 176 of the first limit screw 124 to engage corresponding radially-outwardly oriented projections 178 of the axle to rotationally fix the two with respect to each other.

A second end 146 of the axle 138 may be disposed adjacent to a second end 148 of the first limit screw 124 and may be received within a bore 150 at a first end 152 of the second limit screw 126 such that an end surface 154 of the axle 138 abuts an internal shoulder 156 disposed in the bore 150 in the second limit screw. As will be described in greater detail below, this abutment, in combination with a fastener 158, axially locks the axle 138 to the second limit screw 126. The first end 152 of the second limit screw 126 may also be received within the bore 142 at the second end 148 of the first limit screw 124 such that the connection between the axle 138 and the second limit screw 126 exists within the bore of the first limit screw 124 as well. As will be described in greater detail below, the axle 138 and the second limit screw 126 may have features configured to prevent relative rotation therebetween once the two are engaged. Thus, when assembled, the axle 138 and the second limit screw 126 may be axially and rotationally fixed with respect to each other.

A fastener 158 may couple the axle 138 with the second limit screw 126 and the end plate 122. In the illustrated embodiment the fastener 158 is a screw, though it is contemplated that other fastening arrangements could also be used without departing from the disclosure. The fastener 158 may have a head portion 160 disposed in the bore 150 of the second limit screw 126, and a body portion 162 disposed in a bore 164 of the axle 138. An end portion 166 of the fastener 158 may be received within a boss 168 of the end plate 122. The head portion 160 of the fastener 158 may abut the internal shoulder 156 of the second limit screw 126 so that, when tightened, the head draws the second limit screw 126 into fixed engagement with respect to the end surface 154 of the axle 138. At the same time the second limit screw 126 and the axle 138 are drawn into fixed engagement with respect to the end plate 122. Fully tightening the fastener 158 axially and rotationally locks the axle 138 and the second limit screw 126 to the end plate 122.

As can best be seen in FIG. 4, a spring 170 may be disposed about the second end 146 of the axle 138, within the bore 142 of the first limit screw 124. The spring 170 may also be positioned between an end surface 172 of the second limit screw 126 and an internal shoulder 174 disposed in the bore 142 of the first limit screw 124. Since the second limit screw 126 is axially fixed with respect to the end plate 122, the spring 170 may bias the first limit screw 124 toward the end plate 122.

As previously mentioned, during operation it is desirable that the first and second limit screws 124, 126 be rotationally fixed as the roller tube 104 rotates so that the first and second limit nuts 128, 130 can translate along the limit screws as the first and second limit nuts 128, 130 rotate with the roller tube 104. As just described, the second limit screw 126 may be fixed against rotation because it is fastened to the end plate 122. The first limit screw 124 may be rotationally fixed via one or more radially-inwardly oriented projections 176, formed at the first end 144 of the first limit screw 124 that are engageable with corresponding radially-outwardly oriented projections 178 formed on the first end 140 of the axle 138. It will be appreciated that the illustrated arrangement of cooperating projections 176, 178 is but one example of an arrangement for rotationally fixing the first limit screw 124 with respect to the axle 138, and that other arrangements are within the scope of the disclosure. Since the axle 138 is rotationally fixed with respect to the end plate 122, in the configuration shown in FIG. 4, the first limit screw 124 is rotationally fixed with respect to the end plate 122 via the axle 138. As will be described in greater detail later, the projections 176, 178 of the first limit screw 124 and axle 138 may, in some cases, be disengaged from each other to allow the first limit screw 124 to be rotated with respect to the axle.

As further shown in FIGS. 3 and 4, the bushing 132 may support an end of the roller tube 104 so that it rotates along with the roller tube 104. The bushing 132 may have an inner surface 180 that slides against, such as rotates with respect to, the first end 144 of the first limit screw 124, and may have a plurality of external ribs 182 for engaging an inner surface 184 of the roller tube 104. Thus arranged, the bushing 132 and roller tube 104 are rotatable with respect to the end plate 122.

As previously mentioned, the first and second limit nuts 128, 130 of the non-limiting illustrated example are rotationally fixed with respect to the roller tube 104 so that they rotate as the roller tube rotates. Thus, the first and second limit nuts 128, 130 may have respective tube-engaging surfaces 186, 188, which in the illustrated embodiment comprise respective recesses that engage a longitudinally-oriented projection 190 formed on the inner surface 184 of the roller tube. The first and second limit nuts 128, 130 further each include internal threads 192, 194 (FIGS. 11A, 11B) sized and shaped to engage external threads 196, 198 of the first and second limit screws 124, 126. Thus, as mentioned, when the roller tube 104 is rotated, to extend or retract the covering 106, the first and second limit nuts 128, 130 also rotate, and owing to their threaded interaction with the first and second limit screws 124, 126, they translate along the limit screws 124, 126, respectively, until they encounter a stop.

Figure 5A:
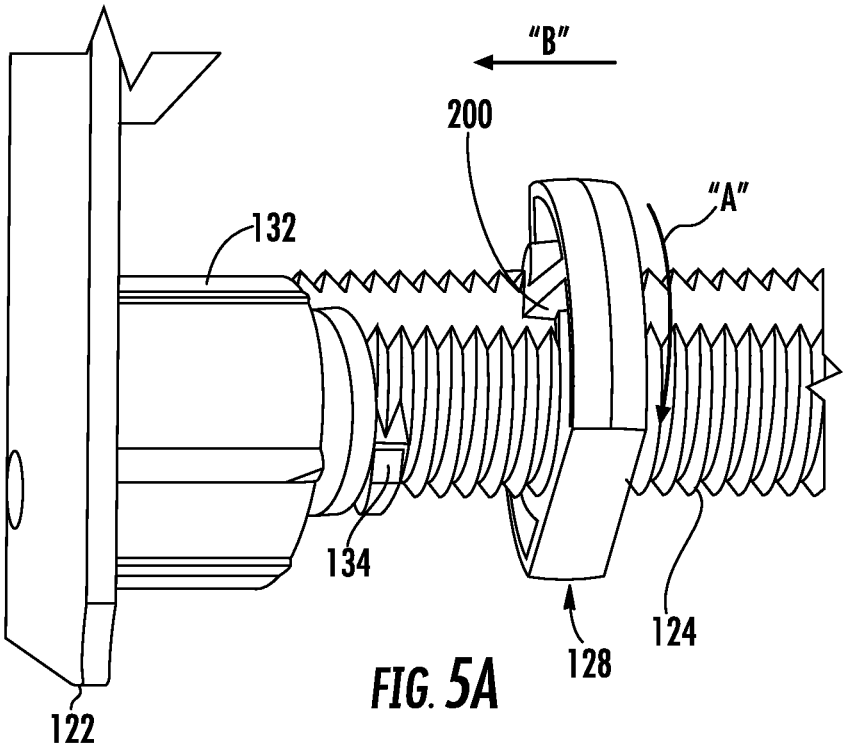
FIGS. 5A and 5B are detail views of a limit stop feature of the example of an adjustment assembly of FIG. 2.
Figure 5B:
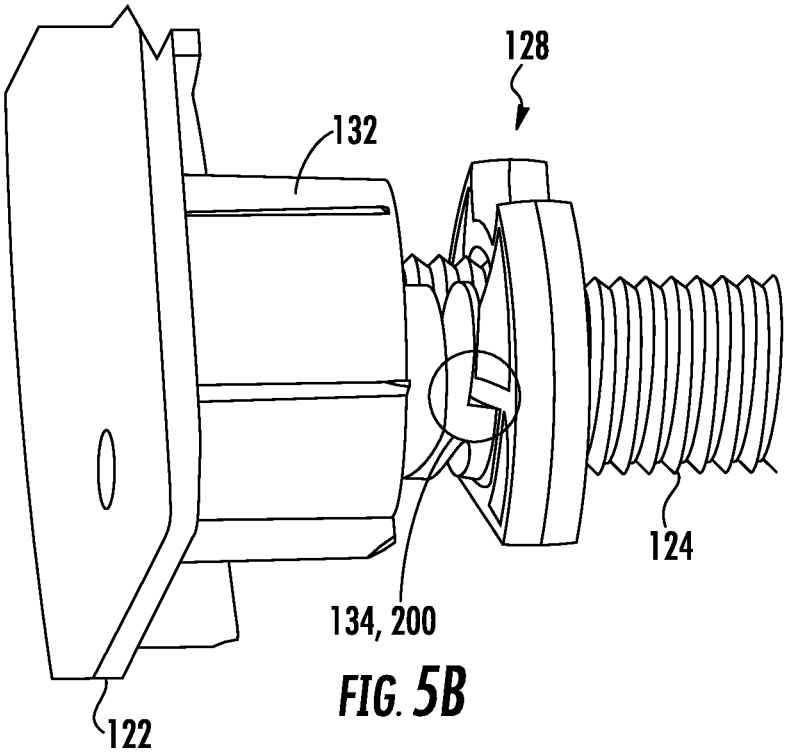

The first and second limit nuts 128, 130 include respective first and second stop surfaces 200, 202, which are configured to engage respective first and second stop surfaces 134, 136 of the first and second limit screws. For convenience, FIGS. 5A and 5B show only the interengagement of the first limit nut 128 and the first limit screw 124. As illustrated in FIG. 5A, as the first limit nut 128 rotates in the direction indicated by arrow "A" the first limit nut also translates in the direction of arrow "B" toward the end plate 122. If the roller tube 104 continues to be rotated, the stop surface 200 of the first limit nut 128 will eventually engage the stop surface 134 of the first limit screw 124, and the engagement of the stop surfaces will prevent further rotation of the nut (and consequently, the roller tube 104 and covering 106). This may represent either a retraction limit or an extension limit for the covering 106.

In the illustrated embodiment the external threads 196, 198 of the first and second limit screws 124, 126 are of opposite hand. Although not shown, it will be appreciated that such an arrangement results in the first and second limit nuts 128, 130 translating away from each other or toward each other as the roller tube 104 rotates in a particular direction. As such, the stop surfaces 134, 136 of the first and second limit screws 124, 126 are positioned closer to the first ends 144, 152 of the first and second limit screws. This arrangement is not critical, however, and other threading arrangements and stop arrangements can be used.

As will be appreciated, by adjusting the initial positions of the first and second limit nuts 128, 130 on the first and second limit screws 124, 126 with respect to the respective stop surfaces 134, 136, the total number of full rotations that the limit nuts are able to undergo before one of the nuts engages a respective stop surface can be adjusted. Since the first and second limit nuts 128, 130 are rotationally fixed with respect to the roller tube 104, the disclosed arrangement makes it possible to adjust the total amount of extension or retraction of the covering 106 connected to the roller tube 104 can undergo.

Figure 6:
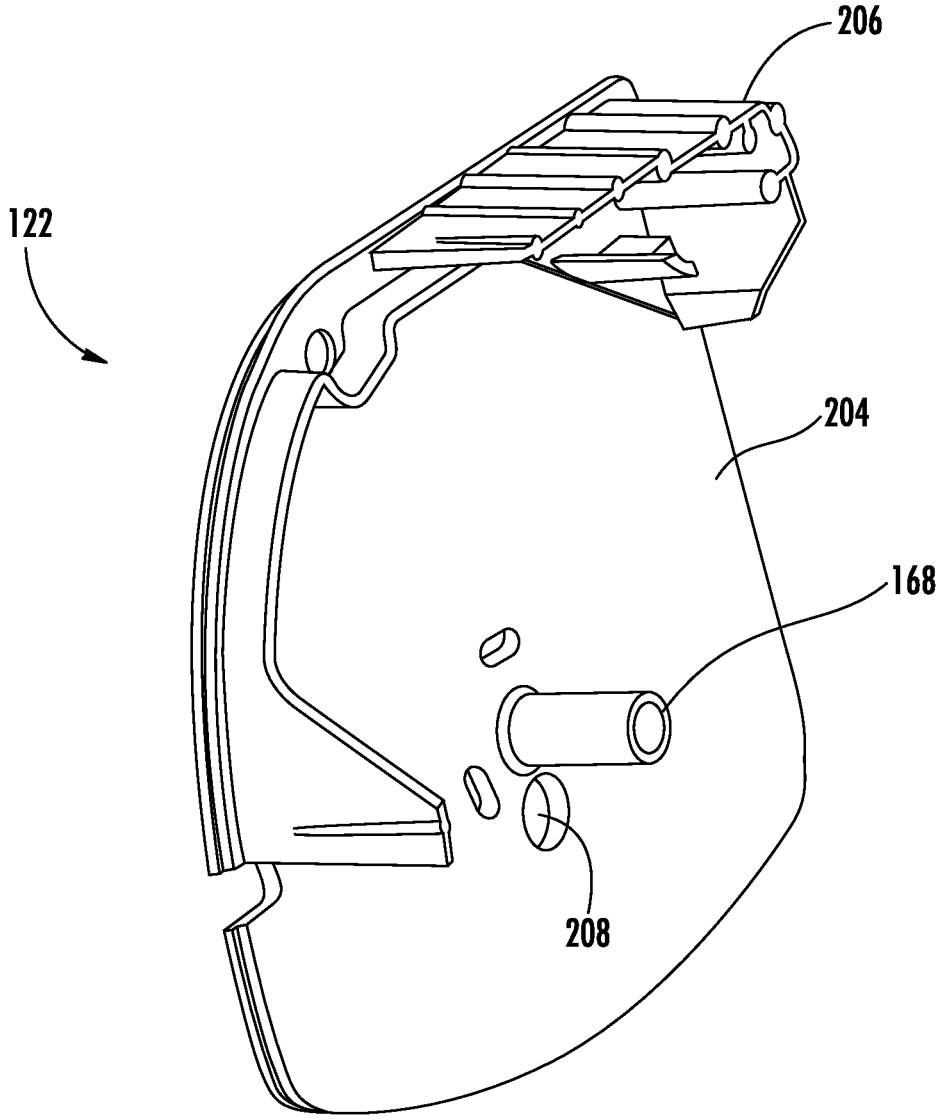
FIG. 6 is a perspective view of an example of an end plate of the example of an adjustment assembly of FIG. 2.

FIG. 6 illustrates an example end plate 122 which includes a plate portion 204, a headrail-engaging portion 206, boss 168, and a tool-receiving opening 208. The headrail-engaging portion 206 is configured to engage the headrail 108 illustrated in FIG. 1. The boss 168 may be configured to be received within the bore 164 of the axle 138 and may receive the end portion 166 of the fastener 158 to couple the axle 138 and the second limit screw 126 to the end plate 122 in the manner previously described in relation to FIG. 4. As will be described in greater detail below, the tool-receiving opening 208 may be disposed adjacent to the boss 168 so that a tool end may be inserted for adjusting an extension or retraction limit of the system.

Figure 7A:
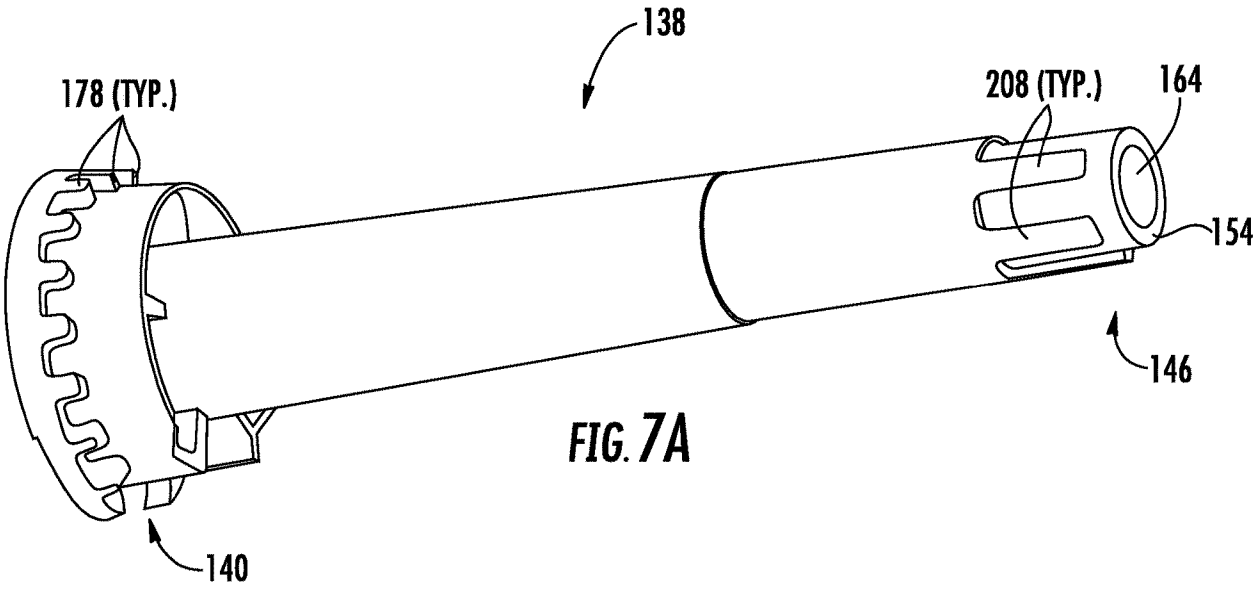
FIG. 7A is a perspective view of an example of an axle of the example of an adjustment assembly of FIG. 2.
Figure 7B:
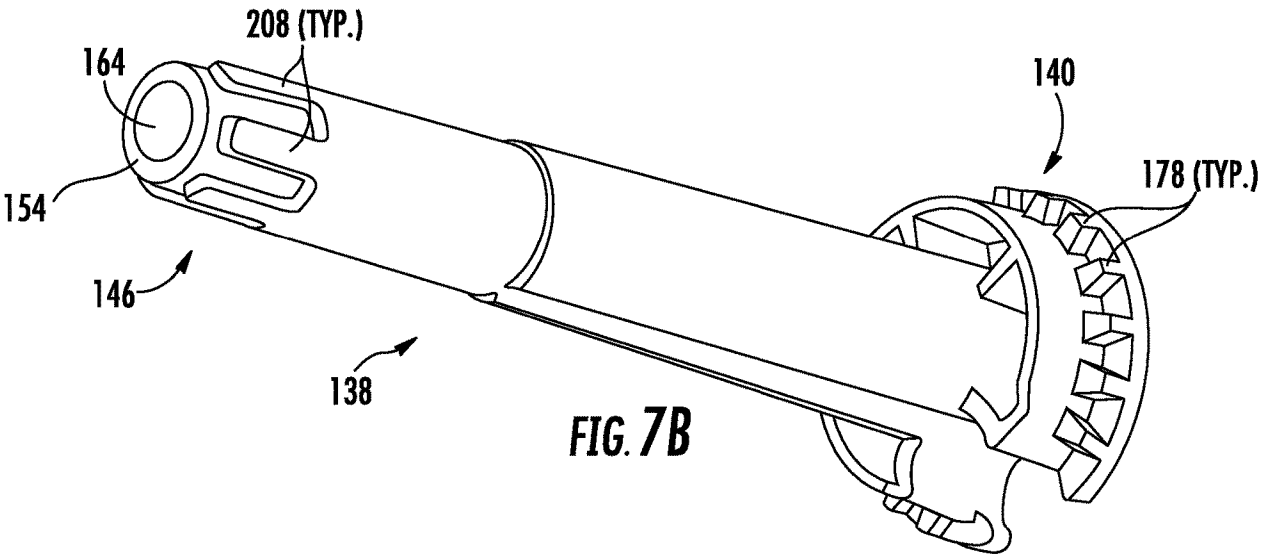
FIG. 7B is another perspective view of the example of an axle of FIG. 7A, shown from another angle.

Referring to FIGS. 7A and 7B, the axle 138 may have first and second ends 140, 146 and a longitudinal bore 164 for receiving the fastener 158 therethrough. The first end 140 may include a plurality of radially outwardly disposed projections 178 for engaging corresponding projections of the first limit screw 124 as previously described. The second end 146 of the axle 138 may have a series of projections 208 configured to engage correspondingly shaped recesses 212 (FIG. 9B) formed in the first end 152 of the second limit screw 126. This engagement serves to rotationally lock the second limit screw 126 to the axle 138.

Figure 8A:
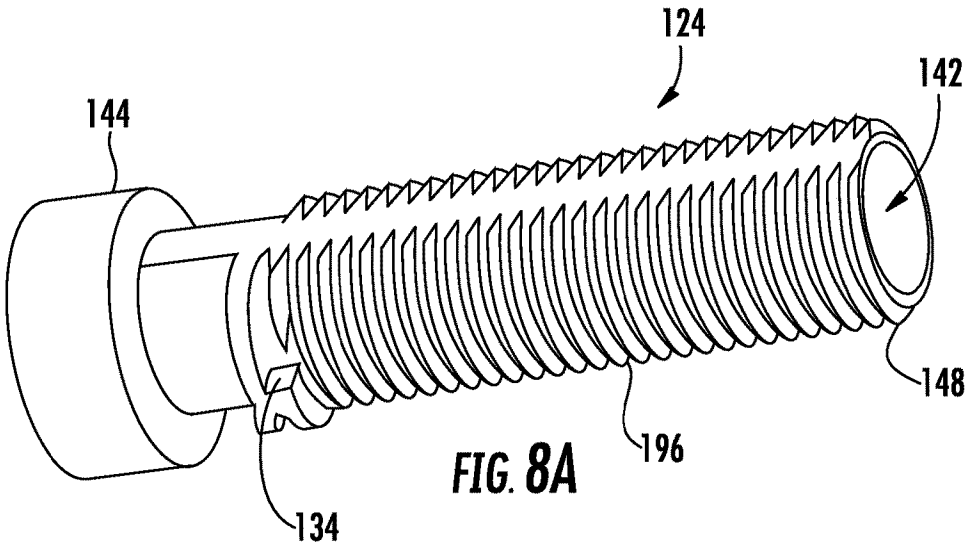
FIG. 8A is an isometric view of an example of a first limit screw of adjustment assembly of FIG. 2.
Figure 8C:
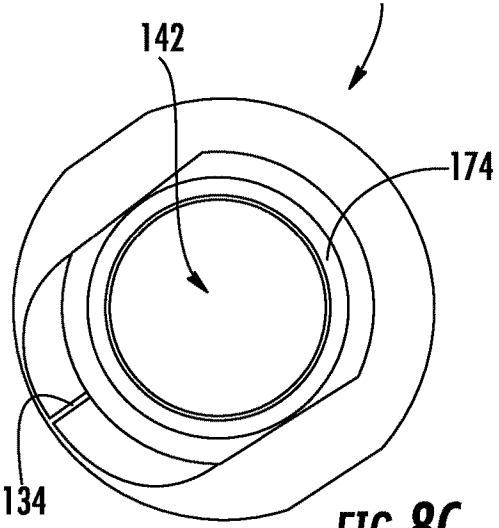
FIG. 8C is an end view of the example of a first limit screw of FIG. 8A.
Figure 8B:
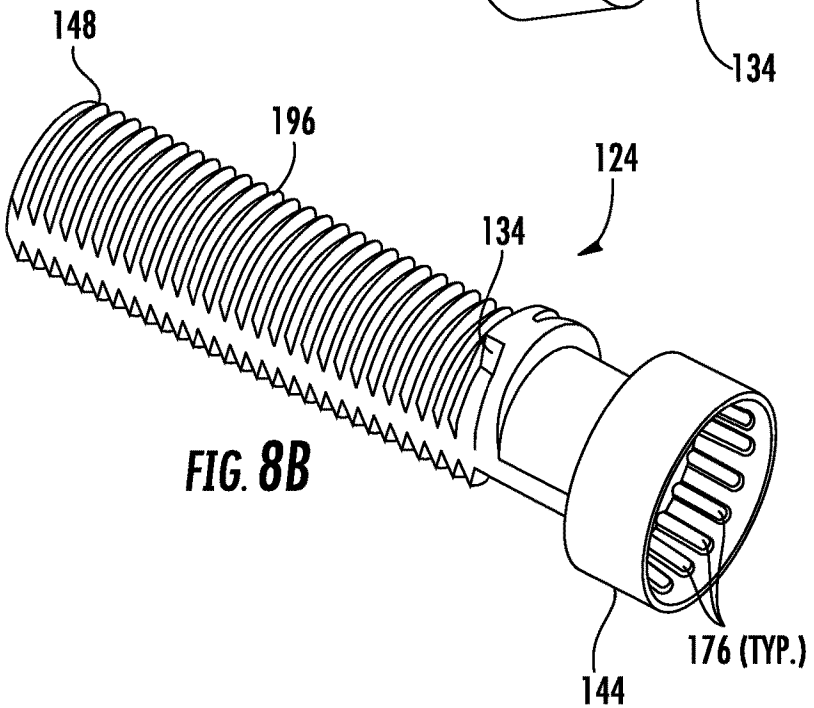
FIG. 8B is another perspective view of the example of a first limit screw of FIG. 8A, shown from another angle.

FIGS. 8A-8C show the first limit screw 124 having first and second ends 144, 148, external threads 196, bore 142, and stop surface 134 as previously described. The bore 142 may be sized to receive the axle 138 and the first end 152 of the second limit screw 126 therein. Visible within the bore 142 is the internal shoulder 174 described in relation to FIG. 4. As mentioned, this internal shoulder 174 is engageable with an end of the spring 170 to bias the first limit screw 124 toward the end plate 122. Radially inwardly oriented projections 176 are shown disposed adjacent to the first end 144 of the first limit screw 124, so that they are engageable with the outwardly oriented projections 178 of the axle 138. As will be appreciated the described arrangement for engaging and inhibiting rotational movement between the axle 138 and the first limit screw 124 is merely an example, and other configurations for engaging the axle and the first limit screw to inhibit relative rotation are within the scope of the present disclosure.

Figure 9A:
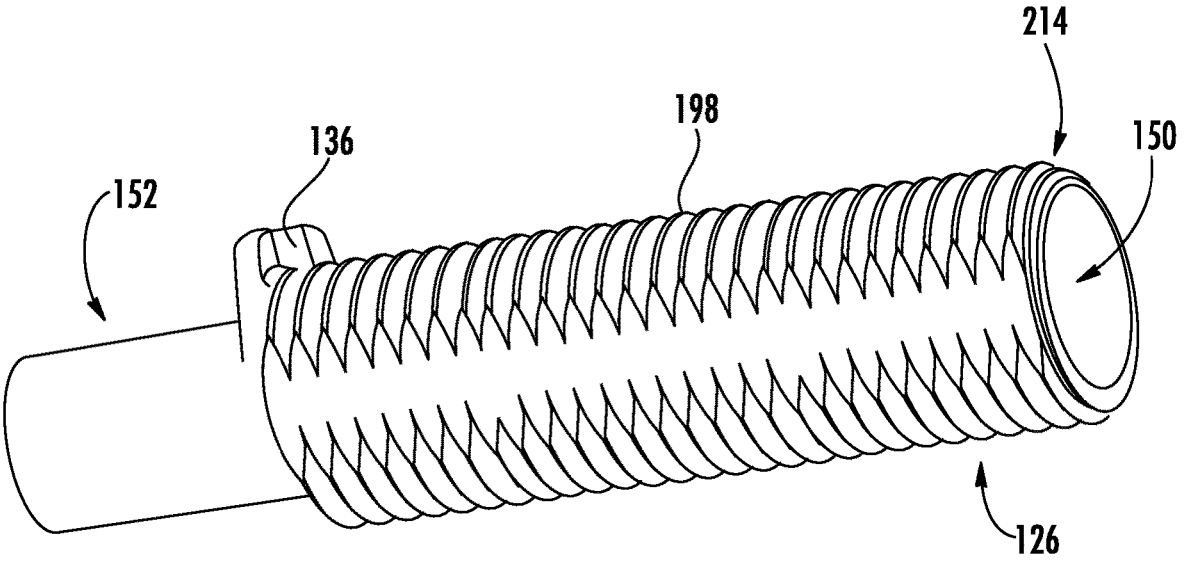
FIG. 9A is a perspective view of an example of a second limit screw of the adjustment assembly of FIG. 2.
Figure 9B:
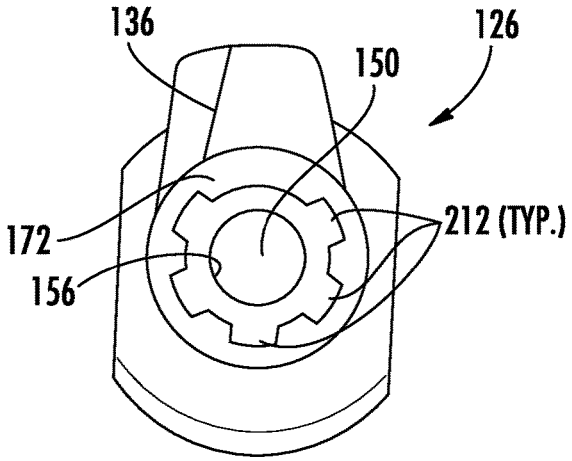
FIG. 9B is an end view of the second limit screw of FIG. 9A.

FIGS. 9A and 9B show the second limit screw 126 having first and second ends 152, 214, external threads 198, bore 150, and stop surface 136 as previously described. Visible within the bore 150 is the internal shoulder 156 described in relation to FIG. 4. As mentioned, this internal shoulder 156 abuts the end surface 154 of the axle 138. In addition, end surface 172 disposed at the first end 152 of the second limit screw 126 is engageable with an end of the spring 170 to bias the first limit screw 124 toward the end plate 122. Recesses 212 are shown disposed adjacent to the first end 152 of the second limit screw 126 and are engageable with the outwardly oriented projections 208 formed at the second end 146 of the axle 138. As will be appreciated the described arrangement for engaging and inhibiting rotational movement between the axle 138 and the second limit screw 126 is merely an example, and other configurations for engaging the axle and the first limit screw to inhibit relative rotation are within the scope of the present disclosure.

Figure 10A:
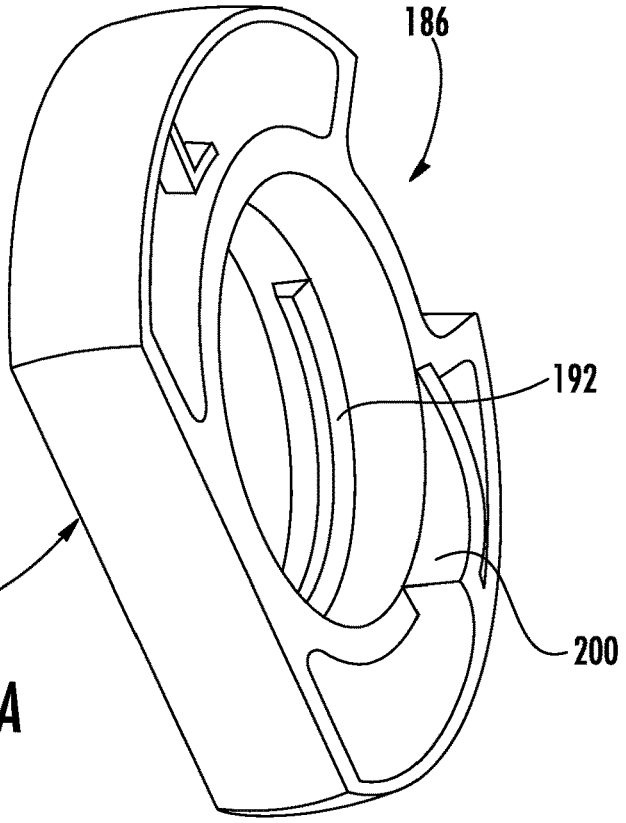
FIG. 10A is a perspective view of an example of a first limit nut of the adjustment assembly of FIG. 2.
Figure 10B:
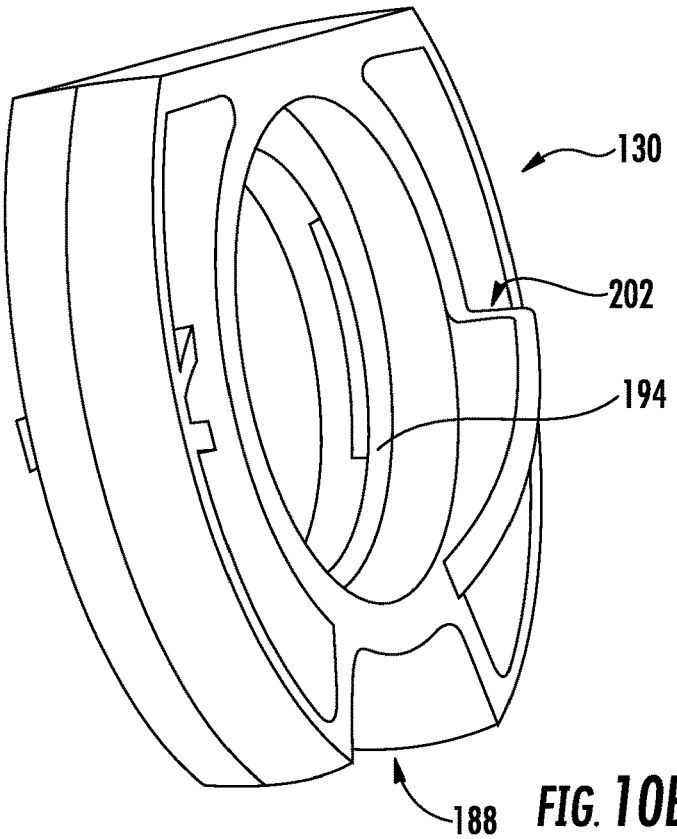
FIG. 10B is a perspective view of an example of a second limit nut of the adjustment assembly of FIG. 2.

FIGS. 10A, 10B show the first and second limit nuts 128, 130, which include respective internal threads 192, 194 sized and shaped to engage external threads 196, 198 of the first and second limit screws 124, 126. First and second stop surfaces 200, 202 comprise projections sized and shaped to engage respective first and second stop surfaces 134, 136 of the first and second limit screws. Tube engaging surfaces 186, 188 comprise respective recesses that are sized and positioned to receive and slide along a longitudinally-oriented projection 190 (FIG. 4) formed on the inner surface 184 of the roller tube 104.

Figure 11:
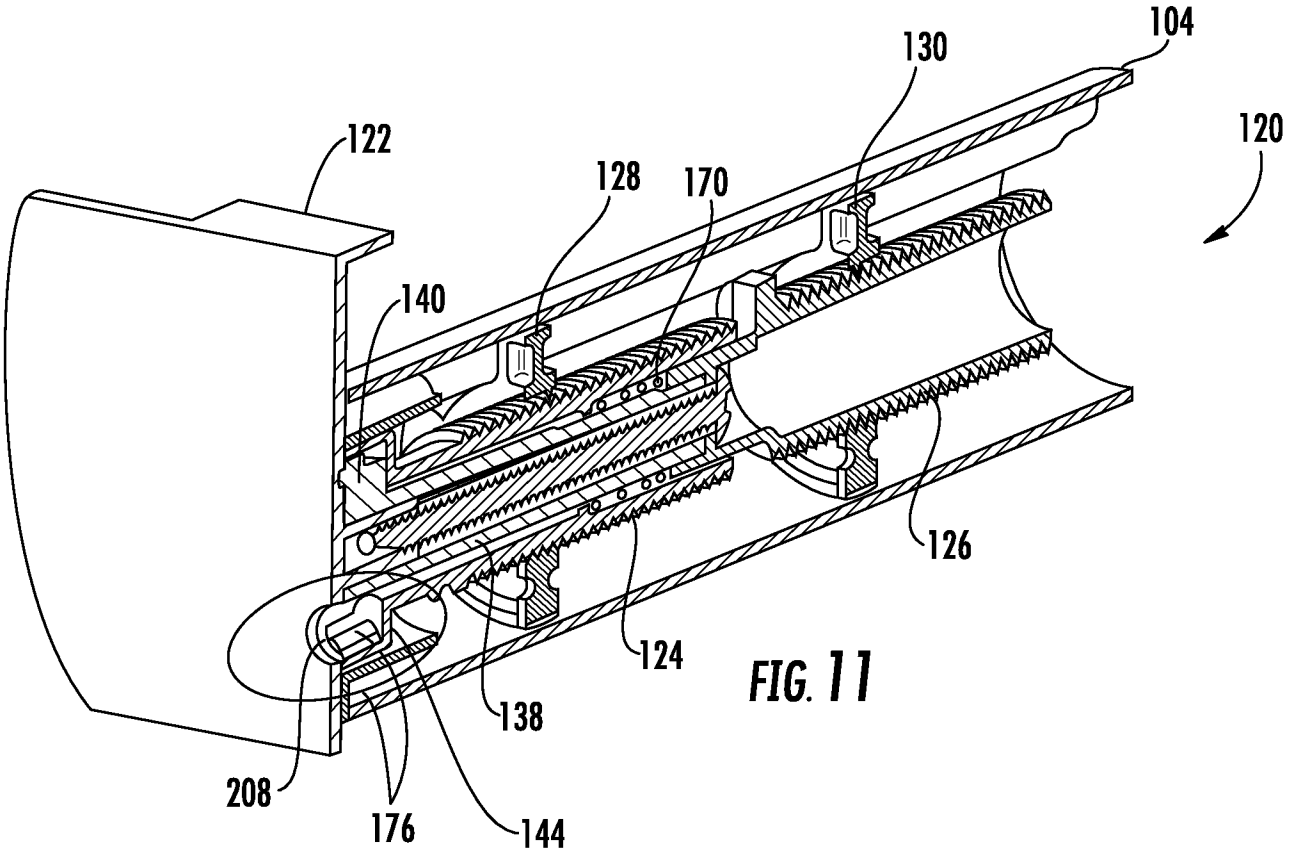
FIG. 11 is a version of the cross-sectional view of FIG. 4, rotated to show the splines of the first limit screw in relation to an opening in the end plate.

Referring now to FIGS. 11-14 an adjustability aspect of the travel limit assembly 120 will be described in greater detail. As can be seen in FIG. 11, the end plate 122 includes tool receiving opening 208 positioned adjacent to the first end 140 of the axle 138. This tool receiving opening 208 exposes a portion of the first end 144 of the first limit screw 124 so that a tool 216 (FIG. 13) can be inserted to engage the first limit screw 124. The tool 216 may be used to move the first limit screw 124 axially and rotationally with respect to the axle 138 to adjust the extension or retraction limit for the roller tube 104 and covering 106. By disengaging (e.g., axially) the first limit screw 124 from the axle 138 and end plate 122, the first limit screw and first limit nut 128 can rotate together, along with the roller tube 104 and covering 106. Once an adjusted extension or retraction position of the covering 106 is achieved, the tool 216 can be removed so that the first limit screw 124 is once again rotationally locked to the axle 138 and end plate 122 via the interaction of projections 176, 178 of the first limit screw and axle, respectively.

Figure 12:
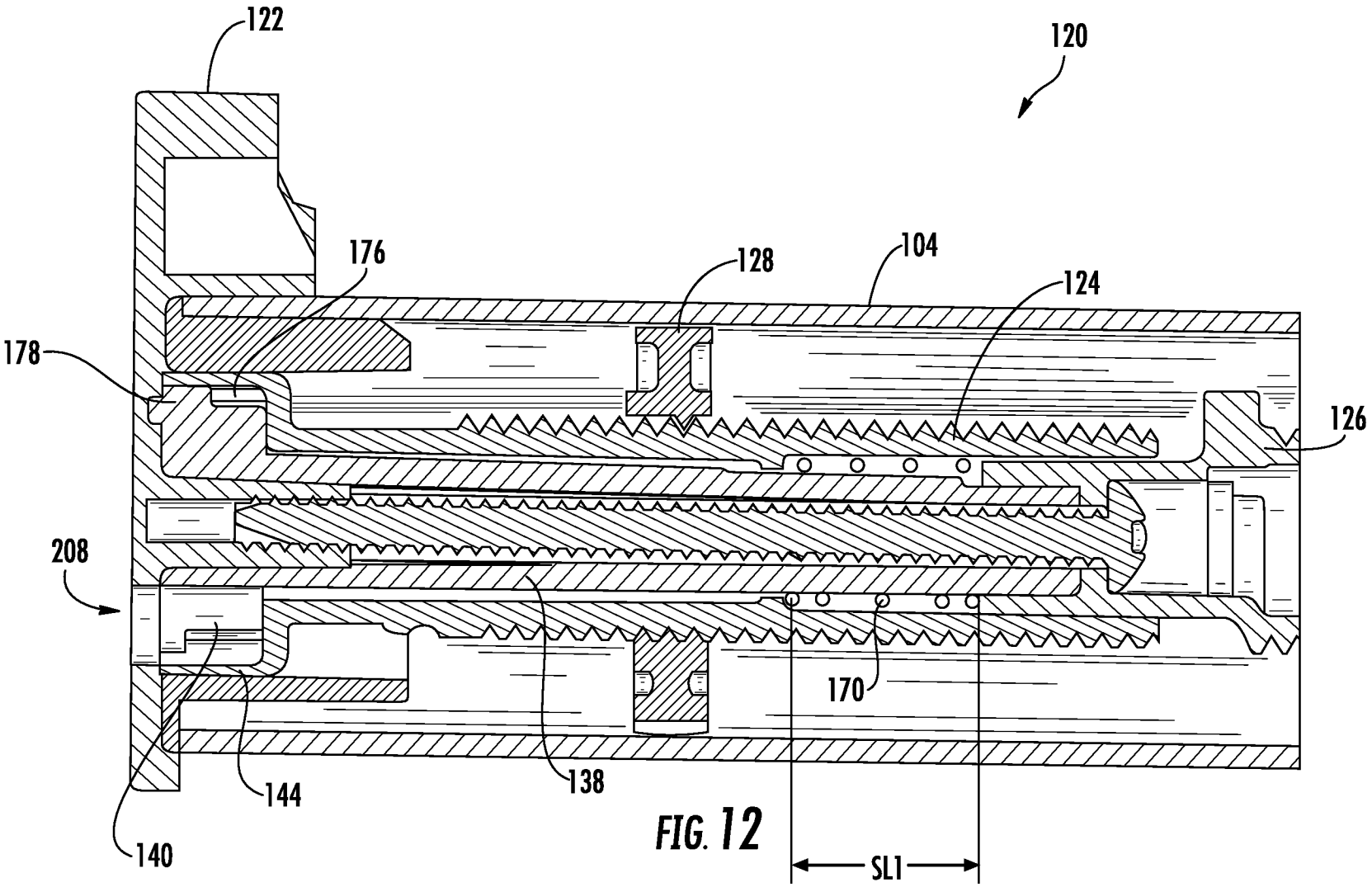
FIG. 12 is a portion of the cross-sectional view of FIG. 4 showing the first limit screw rotationally engaged with the axle.

FIG. 12 shows a configuration of the travel limit assembly 120 in which the first limit screw 124 is in a rotationally locked position with respect to the axle 138. In this rotationally locked position the radially inwardly oriented projections 176 formed at the first end 144 of the first limit screw 124 are engaged with the corresponding radially outwardly oriented projections 178 formed on the first end 140 of the axle 138, and as such, the first limit screw 124 is rotationally locked to the axle 138 (and thus the end plate 122). As will be appreciated, the FIG. 12 configuration is the operational configuration of the travel limit assembly 120. Thus, in this configuration the roller tube 104 and covering 106 may be extended and retracted as limited by the first and second limit nuts 128, 130 according to the initial set positions of the limit nuts on the first and second limit screws 124, 126.

As mentioned, it may be desirable to allow an installer or user to adjust the extension or retraction limit in order suit a particular architectural opening size, or to suit a user's taste. Thus, the disclosed travel limit assembly 120 includes a feature in which the position of the first limit nut 128 can be adjusted along the length of the first limit screw 124 without disassembling the headrail 108 or any portion of the travel limit assembly.

Figure 13:
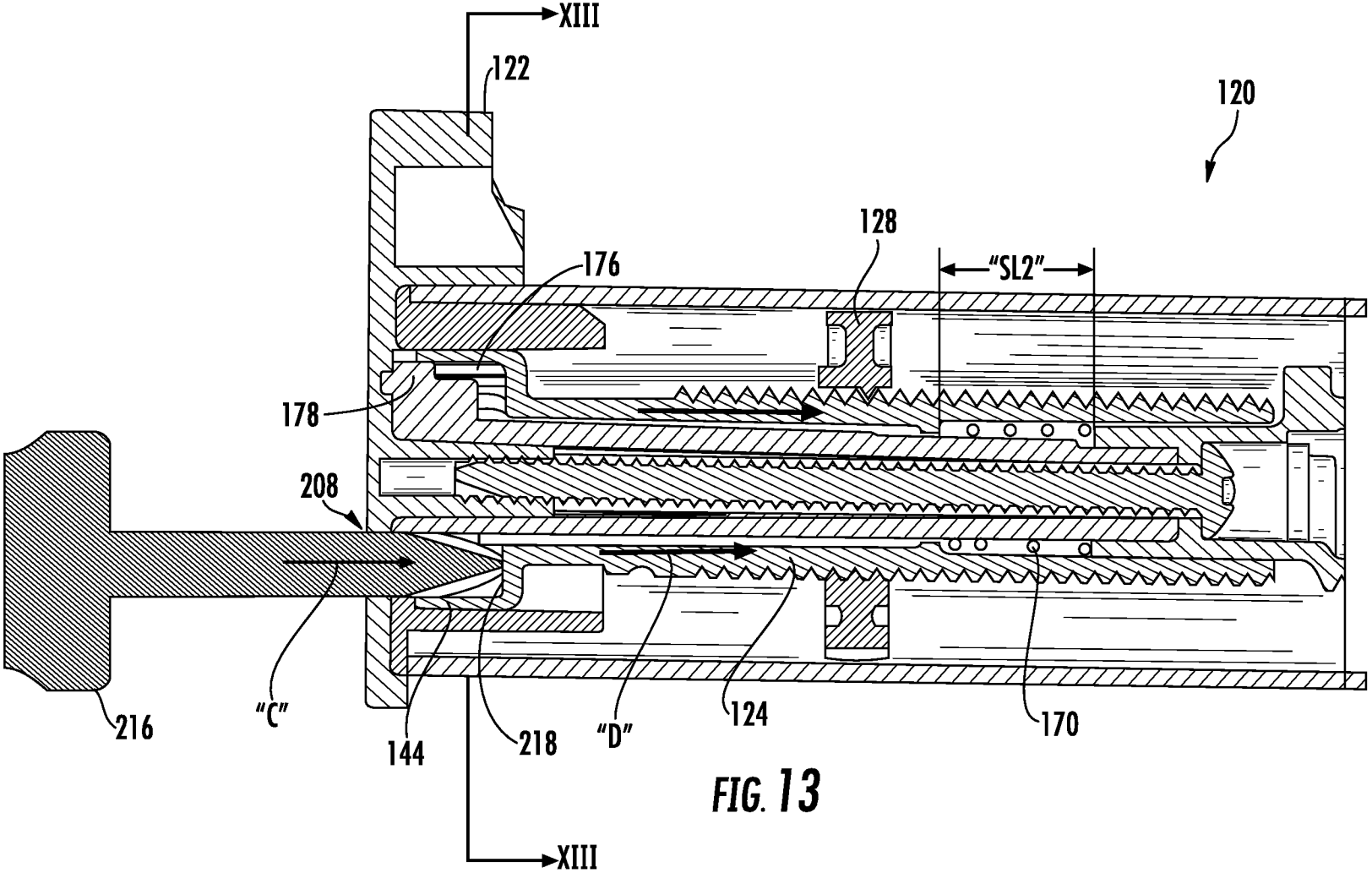
FIG. 13 is a cross-sectional view similar to FIG. 12, but showing the first limit screw rotationally disengaged from the axle through the use of a tool.

FIG. 13 shows the travel limit assembly 120 in an adjustment configuration. As can be seen, a tool 216 (which in the non-limiting example is a Phillips-head screwdriver) has been inserted through the tool receiving opening 208 in the end plate 122 and has engaged an end surface 218 adjacent the first end 144 of the first limit screw 124. In general, the tool 216 can disengage the first limit screw 124 from the axle 138, such as by moving the first limit screw 124 with respect to the axle 138 so that the first limit screw 124 can be rotated with respect to the axle 138. In the illustrated embodiment, the tool 216 can be used to move the first limit screw axially with respect to the axle 138. As, shown, moving the tool 216 in the direction of arrow "C" has overcome the bias in the spring 170 and has caused the first limit screw 124 to move in the direction of arrow "D" to a rotationally unlocked position in which the radially inwardly oriented projections 176 formed at the first end 144 of the first limit screw 124 are no longer engaged with the corresponding radially outwardly oriented projections 178 formed on the first end 140 of the axle 138. As can be seen, when the first limit screw 124 assumes the rotationally unlocked position the spring 170 is compressed from an initial length "SL1" (FIG. 11) to a shorter length "SL2" as the first limit screw moves in the direction of arrow "D" (i.e., toward the second limit screw 126).

Figure 14:
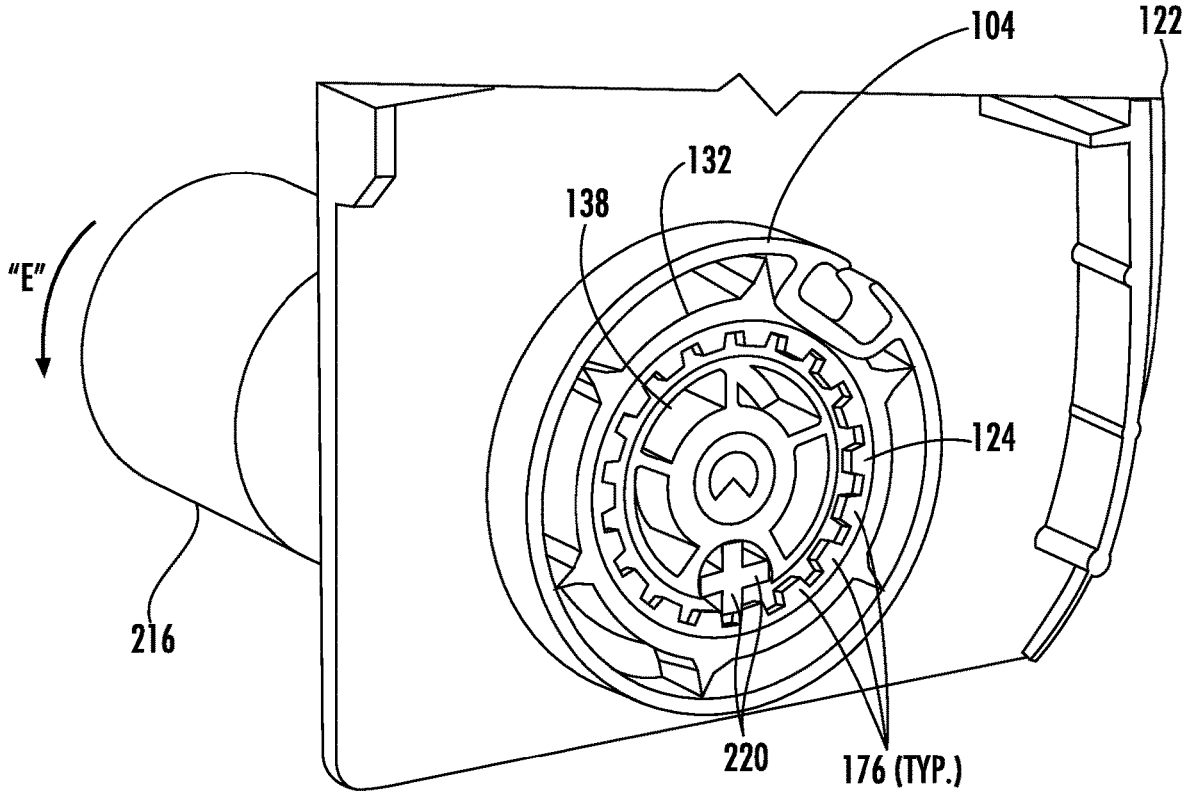
FIG. 14 is a cross-sectional view taken along line XIII-XIII of FIG. 13 showing the tool engaged with splines of the first limit screw.

In this rotationally unlocked position, the first limit screw 124 is free to rotate with respect to the axle 138. FIG. 14 shows the inter-engagement of flutes 220 of the tool 216 with the radially inwardly oriented projections 176 formed at the first end 144 of the first limit screw 124. Rotating the tool 216 in the direction of arrow "E" causes the flutes 220 to engage the projections 176 of the first limit screw 124 and thus cause the first limit screw 124 to rotate in the same direction. In some embodiments, this rotation adjustment may occur while the stop surface 200 of the first limit nut 128 is engaged with the corresponding stop surface 134 of the first limit screw 124 (i.e., the configuration shown in FIG. 5B). Thus, rotating the tool 216 may cause the limit nut 128 and the roller tube 104 to rotate to extend or retract the covering 106 by a desired amount.

As will be appreciated, the covering 106 is either extended or retracted depending on the direction of rotation of the tool 216 and the hand of the threads 196 of the first limit screw 124. Once a desired extended or retracted position of the covering 106 has been achieved, the tool 216 can be removed, whereupon the first limit screw 124 can move back toward the rotationally locked position, such as may be caused by the biasing force of the spring 170 may cause. The radially inwardly oriented projections 176 formed at the first end 144 of the first limit screw 124 may re-engage with the corresponding radially outwardly oriented projections 178 formed on the first end 140 of the axle 138, once again rotationally locking the first limit screw 124 to the axle 138 (and thus the end plate 122). The travel limit assembly 120 may then operate as previously described to limit extension and retraction of the roller tube 104 and covering 106, with the newly adjusted travel limit implemented.

Figure 15A:
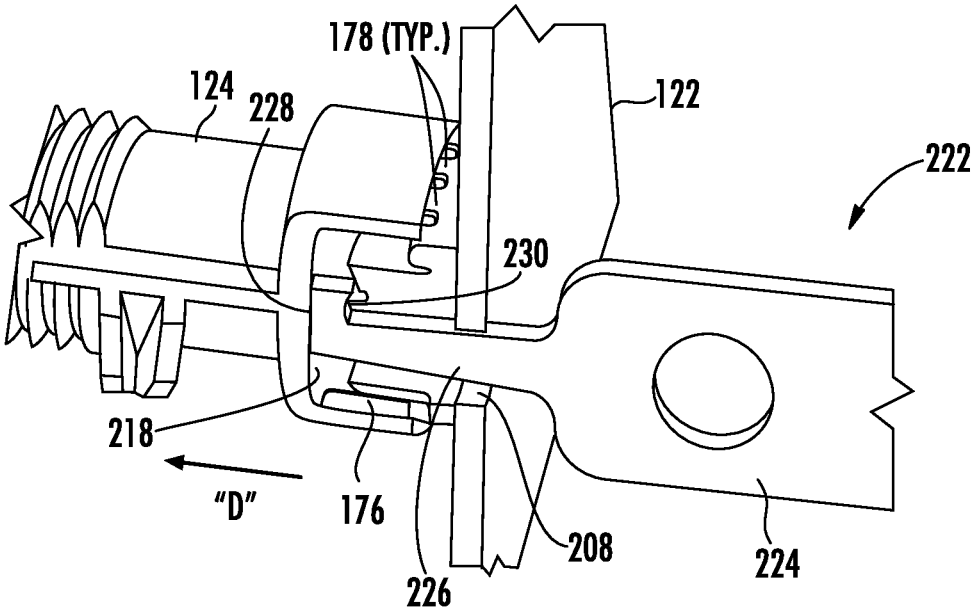
FIG. 15A is a cutaway view of a portion of the adjustment assembly of FIG. 2, showing the interaction of a release tool with the adjustment assembly.
Figure 15B:
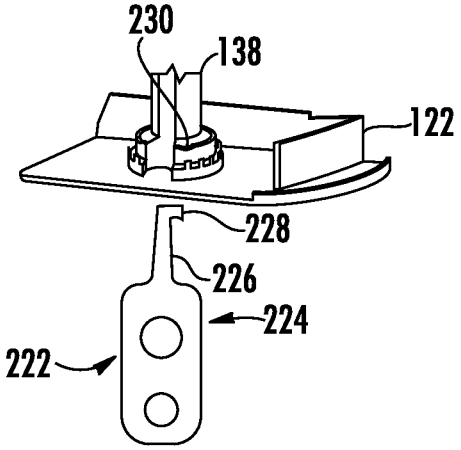
FIG. 15B is a detail view of the portion of the adjustment assembly of FIG. 15A, showing a pre-insertion position of the release tool with respect to the adjustment assembly.
Figure 15C:
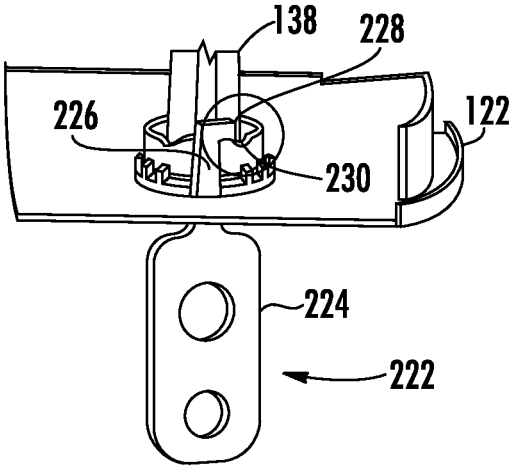
FIG. 15C is a detail view of the portion of the adjustment assembly of FIG. 15A, showing a post-insertion position of the release tool with respect to the adjustment assembly.
Figure 16:
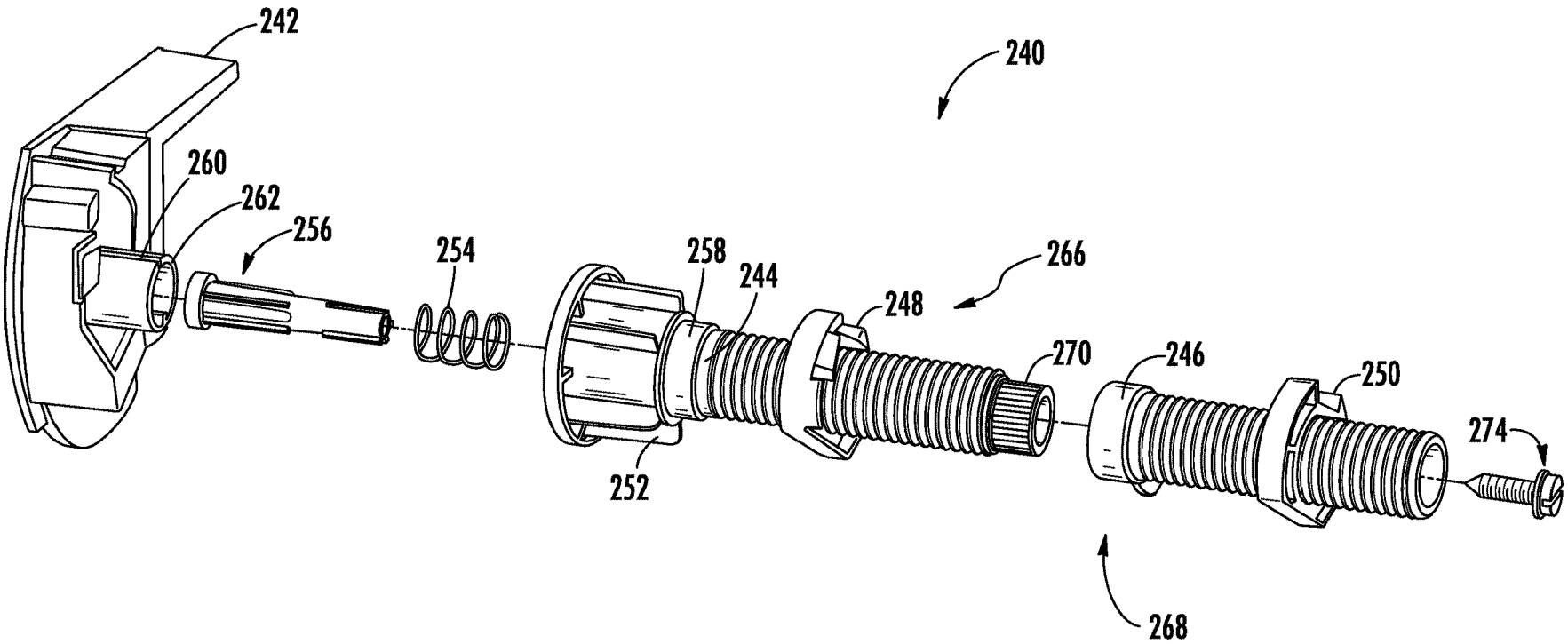
FIG. 16 is an exploded view of an embodiment of an alternative adjustment assembly for use in the architectural covering assembly of FIG. 1.
Figure 17:
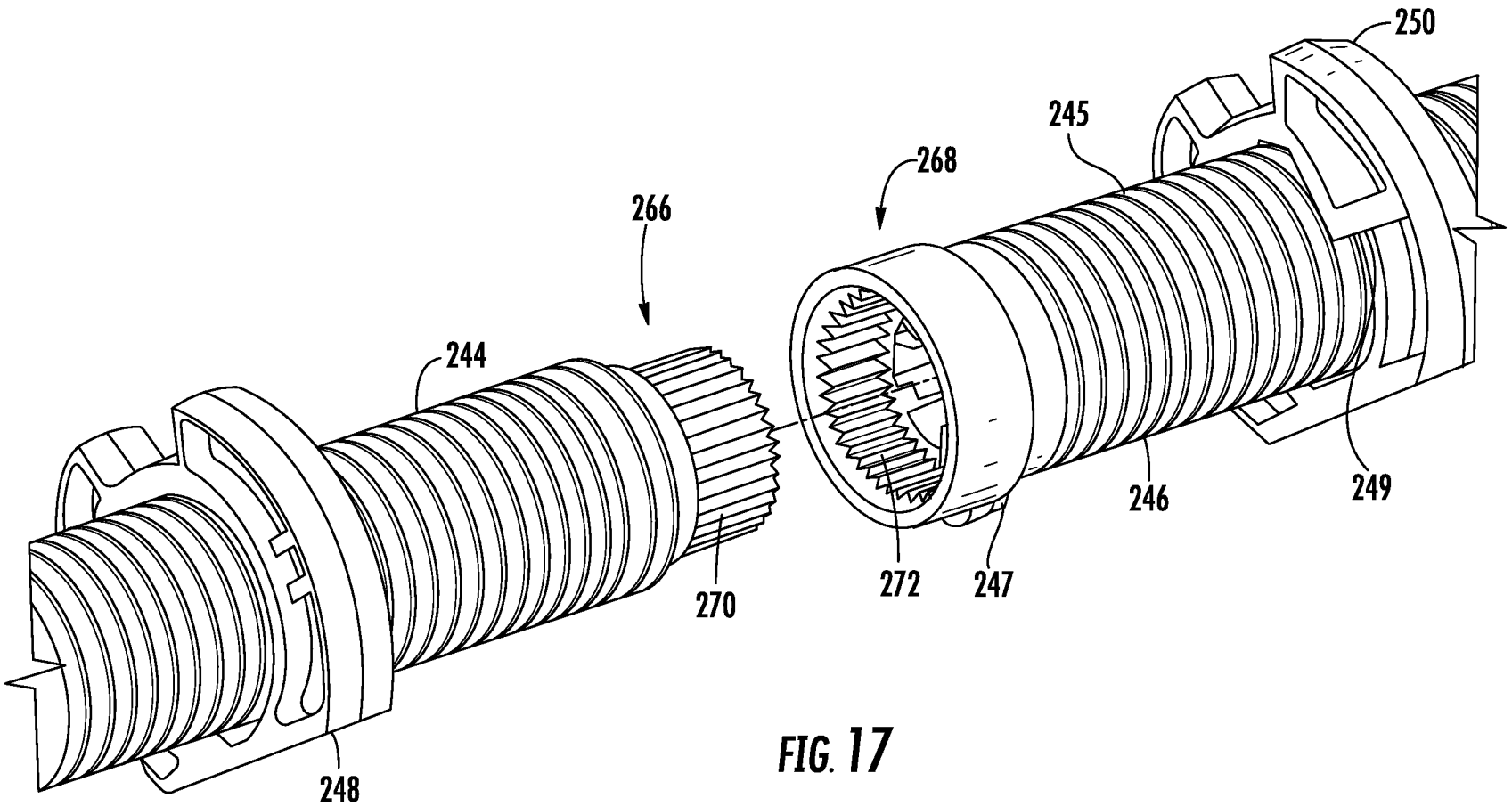
FIG. 17 is perspective view of a portion of the exploded view of FIG. 16, shown from another angle, showing opposing splines disposed on the first and second limit screws.

FIGS. 15A-C illustrate a release feature of the disclosed travel limit assembly 120. In some embodiments it may be desirable to rotationally disengage the first limit screw 124 from the axle 138 so that it may be freely rotatable for ease of fabrication of the covering 106 and/or other aspect of the system. The release feature may be implemented using a tool structured to maintain the first limit screw 124 in a disengaged position with respect to the axle 138 so the stop position between the first limit screw 124 and the first limit nut 128 may be adjusted freely and indirectly (e.g., without directly accessing or moving the nut/stop) such as by adjusting a length of the covering and rotating the roller tube. In the illustrated embodiment a release tool 222 can have a body portion 224, a longitudinal projection portion 226 and a hook portion 228 disposed at the longitudinal projection portion. A user grasping the body portion 224 can insert the hook portion 228 through the tool receiving opening 208 in the end plate 122 until the hook portion engages end surface 218 of the first limit screw 124. Pressing the release tool 222 against the end surface 218 overcomes the bias in the spring 170 and causes the first limit screw 124 to move in the direction of arrow "D" to the rotationally unlocked position in which the projections 176 of the first limit screw 124 are disengaged from the projections 178 of the axle 138. The hook portion 228 of the release tool 222 may rest on a correspondingly-shaped ledge surface 230 of the axle 138, which may serve to temporarily lock the release tool in position and lock the first limit screw 124 in the rotationally unlocked position. The first limit screw 124 may then be freely rotated along with the first limit nut 128 and the roller tube 104. In some embodiments, this free rotation may occur while the stop surface 200 of the first limit nut 128 is engaged with the corresponding stop surface 134 of the first limit screw 124 (i.e., the configuration shown in FIG. 5B). Thus, when the roller tube 104 and covering 106 are freely rotated to assume a desired fully retracted or fully extended position and the release tool 222 is disengaged from the travel limit assembly 120, the adjustable travel limit becomes set at that position. It will be appreciated that the illustrated embodiment is but one example of an implementation of a release tool and release arrangement, and it is contemplated that other tools and techniques can be implemented without departing from the scope of the disclosure.

FIGS. 16-19 show an alternative arrangement of a travel limit assembly 240 including an end plate 242, first and second limit screws 244, 246, first and second limit nuts 248, 250, bushing 252 and spring 254. Travel limit assembly 240 also includes a coupling 256 for releasably coupling the first and second limit screws 244, 246 together. The travel limit assembly 240 may include some or all of the features of the travel limit assembly 120 described in relation to FIGS. 2-15C, except that the first limit screw 244 of this embodiment remains rotationally and axially fixed with respect to the end plate 242, while the second limit screw 246 is selectively adjustable, both axially and rotationally, with respect to the end plate.

Thus, except where described otherwise, the first and second limit screws and the first and second limit nuts of the travel limit assembly 240 may have some or all of the same features described in relation the previous embodiment, including external threading, internal threading, roller tube engaging surfaces, and stop surfaces.

The first limit screw 244 may have a first end 258 that is keyed to the end plate 242 via a slot 260 in an end plate boss 262 into which a projection 264 (FIG. 18) on the first limit screw 244 may fit. This keyed interaction prevents relative rotation between the first limit screw 244 and the end plate 242. The first limit screw 244 may have a second end 266 that fits within a bore in a first end 268 of the second limit screw 246. As can best be seen in FIG. 17, the first and second limit screws 244, 246 may be rotationally coupled together via corresponding splines 271, 273 formed on the second end 266 of the first limit screw 244 and the first end 268 of the second limit screw. It will be appreciated that the illustrated keyed arrangement is but one example of a manner in which the first limit screw 244 is rotationally fixed with respect to the end plate 242, and it is contemplated that other appropriate arrangements can be implemented without departing from the scope of the disclosure.

Figure 18:
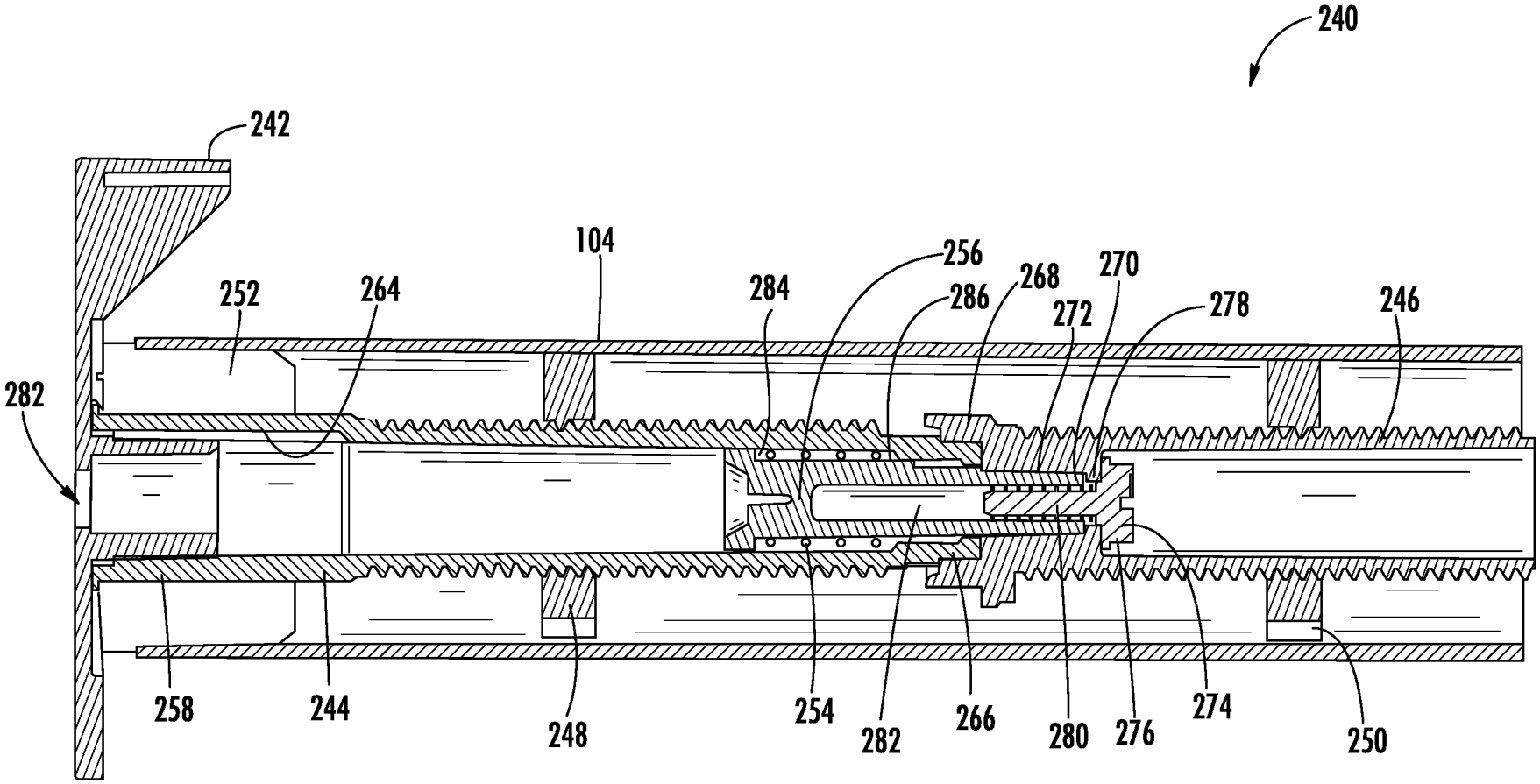
FIG. 18 is a cross-sectional view of the alternative adjustment assembly of FIG. 16 showing the first and second limit screws rotationally engaged with each other.

As shown best in FIG. 18 coupling 256 may be partially disposed in a bore 270 of the first limit screw 244 and partially disposed in a bore 272 of the second limit screw 246. A fastener 274 disposed in the bore 272 of the second limit screw 246 may have a head portion 276 that engages an internal shoulder 278 of the second limit screw, and a body portion 280 that engages a recess 282 in the coupling 256. The fastener 274 may fix the coupling 256 axially and rotationally with respect to the second limit screw 246. A spring 254 may be disposed between a shoulder 284 of the coupling 256 and an internal shoulder 286 of the first limit screw 244 to bias the second limit screw 246 into engagement with the first limit screw 244.

As with the embodiment of FIGS. 2-15C, the travel limit assembly 240 of FIGS. 16-19 includes a feature that enables an installer or user to adjust the extension or retraction limit of the roller tube 104 and covering 106 in order to suit a particular architectural opening size, or to suit a user's taste. The disclosed travel limit assembly 240 includes a feature in which the extension or retraction limit of the covering 106 can be adjusted without disassembling or dismounting the headrail 108 or any portion of the travel limit assembly.

FIG. 18 shows a configuration of the travel limit assembly 240 in which the second limit screw 246 is in a rotationally locked position with respect to the end plate 242. In this rotationally locked position the splines 272 of the second limit screw are engaged with the splines 270 of the first limit screw 244, and thus the second limit screw 246 is rotationally locked to the end plate 242. This configuration represents the operational configuration of the travel limit assembly 240. Thus, in this configuration the roller tube 104 and covering 106 may be extended and retracted as limited by the first and second limit nuts 248, 250 according to the initial set positions of the limit nuts on the first and second limit screws 244, 246.

Figure 19:
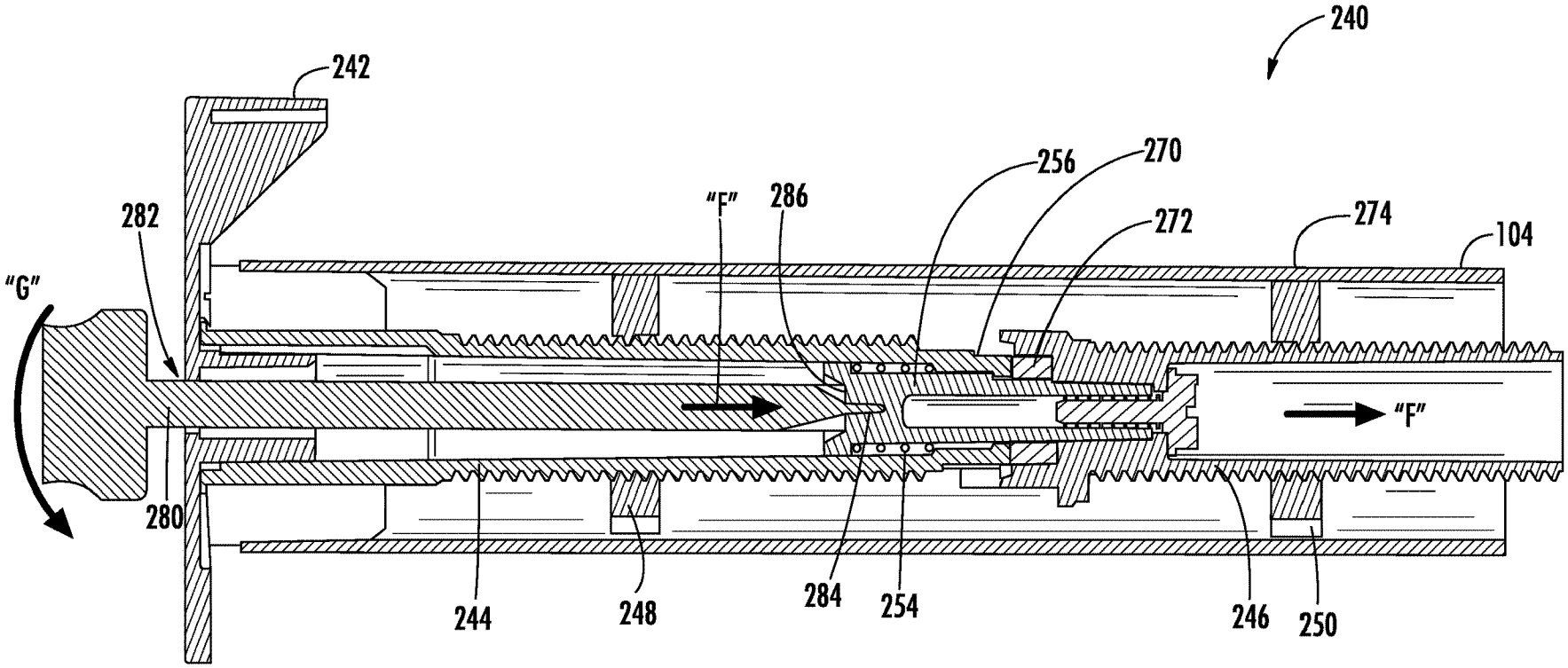
FIG. 19 is a cross-sectional view of FIG. 18 showing the first limit screw rotationally disengaged from the axle.

FIG. 19 shows the travel limit assembly 240 in an adjustment configuration. As can be seen, a tool 280 (which in the non-limiting example illustrated embodiment is a Phillips-head screwdriver) has been inserted through a tool-receiving opening 282 in the end plate 242 and has engaged a recess 284 in a first end 286 of the coupling 256. Moving the tool 280 in the direction of arrow "F" overcomes the bias in the spring 254 and causes the second limit screw 246 to move in the direction of arrow "F" to a rotationally unlocked position in which the splines 272 of the second limit screw 246 are no longer engaged with the splines 270 of the first limit screw 244. In this rotationally unlocked position, the second limit screw 246 is free to rotate with respect to the first limit screw 244 and the end plate 242. With the second limit screw 246 in the rotationally unlocked position, rotating the tool 280 in the direction of arrow "G" causes the coupling 256 to rotate, thus causing the second limit screw to rotate in the same direction.

In some embodiments, this rotation adjustment may occur while a stop surface 249 (FIG. 17) of the second limit nut 250 is engaged with the corresponding stop surface 247 of the first limit screw 246. Thus, rotating the tool 280 may cause the second limit screw 246, the second limit nut 250 and the roller tube 104 to rotate, thereby extending or retracting the covering 106 by a desired amount. As will be appreciated, the covering 106 is either extended or retracted depending on the direction of rotation of the tool 280 and the hand of the threads 245 of the second limit screw 246. As will be appreciated, the direction of translation can be controlled depending on the direction of rotation of the tool 280 and the hand of the threads 245 of the second limit screw 246.

Once a desired translation has been achieved, the tool 280 can be removed, whereupon the second limit screw 246 can move with respect to the first limit screw 244 to rotationally lock the two together. In the illustrated embodiment, removal of the tool 280 may allow the biasing force of the spring 254 to cause the second limit screw 246 to move axially back toward the rotationally locked position such that the splines 270, 272 of the first and second limit screws 244, 246 re-engage. This again rotationally locks the second limit screw 246 to the first limit screw 244 and end plate 242. The travel limit assembly 240 may then operate as previously described to limit extension and retraction of the roller tube 104 and covering 106, with the newly adjusted travel limit implemented.

The claimed subject matter is directed to an architectural covering assembly 100 including a rotatable roller tube 104 and a covering 106 coupled with the rotatable roller tube. The covering 106 is movable between an extended position and retracted position. The assembly also includes an end plate 122, an axle 138 having a first end 140 coupled to the end plate, and a first limit screw 124 having a bore 142, where at least a portion of the axle is disposed within the bore. A second limit screw 126 has a first end 152 coupled to a second end 146 of the axle 138, and the first end of the second limit screw is received within the bore 142 of the first limit screw 124. A first limit nut 128 is coupled to the rotatable roller tube 104 so that it rotates with the rotatable roller tube. The first limit nut 128 is threadably engaged with external threads 196 of the first limit screw 124. A second limit nut 130 is coupled to the rotatable roller tube 104 so that it rotates with the rotatable roller tube. The second limit nut 130 is also threadably engaged with external threads 198 of the second limit screw 126. The first limit screw 124 is selectively rotationally movable about the axle 138 to adjust an extension or retraction limit of the covering 106.

The claimed subject matter is also directed to an architectural covering assembly 100 including a rotatable roller tube 104, and a covering 106 coupled to the rotatable roller tube. The covering 106 is movable between an extended position and retracted position. The assembly also includes an end plate 242, and a first limit screw 244 having first and second ends 258, 266 and a bore. The first end 258 is coupled to the end plate 242. A second limit screw 246 has a first end 268 and also has a bore for receiving the second end 266 of the first limit screw 244. A coupling 256 is received within the bores 271, 273 of the first and second limit screws 244, 246, and the coupling is axially and rotationally fixed with respect to the second limit screw. The coupling 256 is rotationally and axially movable with respect to the first limit screw 244. A first limit nut 248 may be coupled to the rotatable roller tube 104 so that the first limit nut rotates with the rotatable roller tube. The first limit nut 248 is also threadably engaged with external threads 243 of the first limit screw 244. A second limit nut 250 is coupled to the rotatable roller tube 104 so that the second limit nut rotates with the rotatable roller tube. The second limit nut 250 is threadably engaged with external threads 245 of the second screw 246. The second limit screw 246 is selectively movable between a rotationally locked position and a rotationally unlocked position with respect to the first limit screw 244. In the rotationally locked position, a projection 270 of the first limit screw 244 is engageable with a projection 272 of the second limit screw 246 to prevent relative rotation therebetween. In the rotationally unlocked position the projection 272 of the second limit screw 246 is axially separated from the projection 270 of the first limit screw 244 to enable the second limit screw 246 to rotate with respect to the first limit screw to adjust an extension or retraction limit of the covering 106.

The claimed subject matter is further directed to an architectural covering assembly 100 including a rotatable roller tube 104, and a covering 106 coupled to the rotatable roller tube. The covering 106 is movable between an extended position and retracted position. The assembly also includes an end plate 122; 242 and first and second limit screws 124, 126; 244, 246 each have respective first and second ends. The second end of the first limit screw 124; 244 is engageable with the first end of the second limit screw 126; 246. One of the first and second limit screws 124, 126; 244, 246 is rotationally and axially fixed with respect to the end plate 122; 242, and the other of the first and second limit screws is selectively movable between a rotationally locked position and a rotationally unlocked position with respect to the end plate 122; 242. A first limit nut 128; 248 is coupled to the rotatable roller tube 104, and is threadably engaged with external threads of the first limit screw 124; 242. A second limit nut 130; 250 is coupled to the rotatable roller tube 104, and is threadably engaged with external threads of the second limit screw 126; 246. In the rotationally locked position the other of the first and second limit screws is axially and rotationally fixed with respect to the end plate 122. In the rotationally unlocked position the other of the first and second limit screws 124, 126; 244, 246 is rotationally movable with respect to the end plate 122; 242 to adjust an extension or retraction limit of the covering 106.

The claimed subject matter is also directed to an architectural covering assembly 100 including a rotatable roller tube 104, and a covering 106 coupled to the rotatable roller tube, where the covering is movable between an extended position and retracted position. The assembly also includes a limit screw 124; 246 having first and second ends 144, 148; 268, and a limit nut 128; 250 coupled to the rotatable roller tube 104. The limit nut 128; 250 is threadably engaged with external threads 196; 245 of the limit screw 124; 246. The limit screw 124; 246 is selectively movable between a rotationally locked position with respect to the rotatable roller tube 104 and a rotationally unlocked position with respect to the rotatable roller tube. In the rotationally unlocked position the limit screw 124; 246 is rotationally movable with respect to the rotatable roller tube 104, while in the rotationally locked position the limit screw 124; 246 is rotatable with the rotatable roller tube to adjust an extension or retraction limit of the covering 106.

The claimed subject matter is also directed to a method of adjusting an extension or retraction limit of an architectural covering assembly 100. In some non-limiting examples the architectural covering assembly 100 includes a rotatable roller tube 104 and a covering 106 coupled to the rotatable roller tube, where the covering 106 is movable between an extended position and retracted position. The assembly also includes an end plate 122; 242 a limit screw 124; 246 having first and second ends 144, 148; 268, and a limit nut 128; 250 coupled to the rotatable roller tube 104, where the limit nut is threadably engaged with external threads 196; 246 of the limit screw 124; 246. The method includes moving a limit screw 124; 246 from a rotationally locked position with respect to the end plate 122; 242 to a rotationally unlocked position with respect to the end plate; rotating the limit screw 124; 246 to rotate the limit nut and the rotatable roller tube 104, where rotating the rotatable roller tube extends or retracts the covering. Moving the limit screw 124; 246 from the rotationally unlocked position with respect to the end plate 122; 242 to the rotationally locked position with respect to the end plate sets an extension or retraction limit of the covering 106.

In some claimed embodiments, when the limit screw 124; 246 is in the rotationally unlocked position with respect to the end plate 122; 242, the rotatable roller tube 104 is rotated (e.g., such as by pulling on the covering 106) to adjust the position of the covering. When a desired positioning of the covering 106 is achieved, the limit screw 124; 246 is returned to the rotationally locked position with respect to the end plate 122; 242 which thereby sets an extension or retraction limit of the covering 106.

In one non-limiting exemplary claimed embodiment, the limit screw 124 is moved from the rotationally locked position to the rotationally unlocked position by engaging a tool 216 with a surface 218 of the limit screw 124. The tool 216 includes flutes 220 for engaging a projection 176 of the limit screw 124, such that rotating the limit screw rotates the flutes, which, in turn, rotates the projection and also rotates the rotatable roller tube 104 to extend or retract the covering 106. In other non-limiting example embodiments, the limit screw 124 is moved from the rotationally locked position to the rotationally unlocked position by engaging a release tool 222 with the surface 218 of the first limit screw 124. The release tool 222 has, in one non-limiting example, a hook end 228 for holding the limit screw 124 in the rotationally unlocked position so that the first limit screw can freely rotate with respect to the end plate 122. As mentioned, the rotatable roller tube 104 is then rotated (e.g., such as by pulling on the covering 106) to adjust the position of the covering. When a desired positioning of the covering 106 is achieved, the limit screw 124 is returned to the rotationally locked position with respect to the end plate 122 by disengaging the release tool 222, which thereby sets an extension or retraction limit of the covering 106.

In the above-described claimed arrangements and methods, an architectural covering is provided having extension and retraction travel limits for a roller shade, where the mechanism for providing such travel limits may be disposed entirely inside the roller tube. In addition, the above-described claimed arrangements and methods allow for adjustment of one of the travel limits from a location outside the roller shade, and without the need to disassemble the roller shade and/or the adjustment assembly.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. The patentable scope of the present subject matter is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims. Moreover, the following claims are hereby incorporated into this Detailed Description by this reference, with each claim standing on its own as a separate embodiment of the present disclosure.

The phrases "at least one", "one or more", and "and/or", as used herein, are open-ended expressions that are both conjunctive and disjunctive in operation. The term "a" or "an" entity, as used herein, refers to one or more of that entity. As such, the terms "a" (or "an"), "one or more" and "at least one" can be used interchangeably herein.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

What is claimed is:

1. An architectural covering assembly comprising:

a rotatable roller tube;

a covering rotatable with the rotatable roller tube, the covering being movable between an extended position and retracted position;

an end plate;

an axle having a first end coupled to the end plate;

a first limit screw having a bore, at least a portion of the axle disposed within the bore;

a second limit screw having a first end rotationally fixed with a second end of the axle, a first limit nut rotatable with the rotatable roller tube, the first limit nut threadably engaged with external threads of the first limit screw; and a second limit nut rotatable with the rotatable roller tube, the second limit nut threadably engaged with external threads of the second limit screw;

wherein:

the first limit screw is configured to move axially along a major longitudinal length of the axle from a rotationally locked position to a rotationally unlocked position; and in the rotationally unlocked position, the first limit screw is configured to be rotationally movable about the axle to adjust an extension or retraction limit of the covering.

2. The architectural covering assembly of claim 1, wherein the first end of the second limit screw is received within the bore of the first limit screw.

3. The architectural covering assembly of claim 1, wherein, when in the rotationally unlocked position, the first limit screw is configured to be rotationally movable with respect to the first end of the second limit screw.

4. The architectural covering assembly of claim 1, wherein the second limit screw is rotationally fixed with respect to the axle and the end plate.

5. The architectural covering assembly of claim 1, wherein a first end of the first limit screw includes an inwardly radially disposed projection for engaging a corresponding projection on the first end of the axle to prevent relative rotation between the first limit screw and the axle when the first limit screw is in the rotationally locked position with respect to the end plate.

6. The architectural covering assembly of claim 5, wherein when the first limit screw is in said rotationally unlocked position the projections of the first limit screw and the axle are disengaged such that the first limit screw is rotatable with respect to the axle.

7. The architectural covering assembly of claim 6, wherein when said first limit screw is in said rotationally unlocked position, rotation of said first limit screw with respect to the axle causes the first limit nut to rotate with the first limit screw to cause the rotatable roller tube to rotate.

8. The architectural covering assembly of claim 6, further comprising an opening in the end plate adjacent to the first end of the first limit screw, the first limit screw having an engagement surface so that the first limit screw can be moved from the rotationally locked position to the rotationally unlocked position by a tool inserted through the opening and pressing against the engagement surface.

9. The architectural covering assembly of claim 5, further comprising a spring disposed about the axle, wherein the spring is positioned between an internal intermediate shoulder of the first limit screw and an end surface of the second limit screw to bias the first limit screw toward the end plate and bias the inwardly radially disposed projection of the first limit screw to engage the corresponding projection of the axle.

10. The architectural covering assembly of claim 1, wherein the first limit nut includes a first nut stop boss projecting axially outward from a side surface of the first limit nut, and the first limit screw includes a first limit screw stop boss projecting axially outward from a first end of the first limit screw, and wherein when the first limit screw is in the rotationally unlocked position and the first nut stop boss engages the first limit screw stop boss, rotation of the first limit screw causes the rotatable roller tube to rotate to extend or retract the covering.

11. An architectural covering assembly comprising a rotatable roller tube;

a covering rotatable with the rotatable roller tube, the covering being movable between an extended position and retracted position;

an end plate including an axle extending from the end plate;

first and second limit screws each having respective first and second ends, wherein one of the first and second limit screws is rotationally and axially fixed with respect to the end plate, and the other of the first and second limit screws is configured to move axially along a major longitudinal length of the axle movable between a rotationally locked position and a rotationally unlocked position with respect to the end plate;

a first limit nut rotatable with the rotatable roller tube, the first limit nut threadably engaged with external threads of the first limit screw; and a second limit nut rotatable with the rotatable roller tube, the first limit nut threadably engaged with external threads of the second limit screw;

wherein:

in the rotationally locked position the other of the first and second limit screws is axially and rotationally fixed with respect to the end plate; and in the rotationally unlocked position the other of the first and second limit screws is rotationally movable with respect to the end plate to adjust an extension or retraction limit of the covering.

12. The architectural covering assembly of claim 11, wherein the second end of the first limit screw is configured to be engageable with the first end of the second limit screw.

13. The architectural covering assembly of claim 11, wherein the first limit screw is configured to be rotationally movable with respect to the first end of the second limit screw.

14. The architectural covering assembly of claim 11, wherein the second limit screw is rotationally fixed with respect to the axle so that when the first limit screw is rotated about the axle the second limit screw remains rotationally fixed with respect to the axle.

15. The architectural covering assembly of claim 14, wherein the first end of the first limit screw includes an inwardly radially disposed projection for engaging a corresponding projection of the axle to prevent relative rotation between the first limit screw and the axle when the first limit screw is in the rotationally locked position with respect to the end plate.

16. The architectural covering assembly of claim 15, wherein the first limit screw is configured to move axially along the major longitudinal length of the axle to the rotationally unlocked position, and wherein when the first limit screw is in said rotationally unlocked position the projection of the first limit screw is disengaged from the projection of the axle such that the first limit screw is rotatable with respect to the axle and the end plate.

17. The architectural covering assembly of claim 16, wherein the first end of the first limit screw is guided within a bushing for longitudinal movement between the rotationally locked position and the rotationally unlocked position.

18. The architectural covering assembly of claim 16, wherein when said first limit screw is in said rotationally unlocked position, rotation of said first limit screw with respect to the axle causes the first limit nut to rotate with the first limit screw, which causes the rotatable roller tube to rotate.

19. The architectural covering assembly of claim 11, further comprising an opening in the end plate adjacent to the first end of the first limit screw, the first limit screw having an engagement surface so that the first limit screw can be moved from the rotationally locked position to the rotationally unlocked position by a tool inserted through the opening and pressing against the engagement surface.

20. The architectural covering assembly of claim 11, further comprising a spring disposed about the axle, the spring further being disposed between an internal intermediate shoulder of the first limit screw and an end surface of the second limit screw, to bias the first limit screw toward the end plate and to bias a projection of the first limit screw to engage a projection of the axle.

21. The architectural covering assembly of claim 11, wherein the first limit nut includes a first nut stop boss projecting axially outward from a side surface of the first limit nut, and the first limit screw includes a first limit screw stop boss projecting axially outward from the first end of the first limit screw, and wherein when the first limit screw is in the rotationally unlocked position and the first nut stop boss engages the first limit screw stop boss, rotation of the first limit screw causes the rotatable roller tube to rotate to extend or retract the covering.

* * * * *